US007309320B2

(12) United States Patent
Schmehl

(10) Patent No.: US 7,309,320 B2
(45) Date of Patent: Dec. 18, 2007

(54) APPARATUS AND METHOD FOR SUPPORTING AND CONTINUOUSLY FLEXING A JOINTED LIMB

(75) Inventor: Stewart J. Schmehl, Wayne, NJ (US)

(73) Assignee: Ana-Tek, LLC, Wayne, NJ (US)

( * ) Notice: Subject to any disclaimer, the term of this patent is extended or adjusted under 35 U.S.C. 154(b) by 416 days.

(21) Appl. No.: 10/943,743

(22) Filed: Sep. 17, 2004

(65) Prior Publication Data

US 2006/0064044 A1 Mar. 23, 2006

(51) Int. Cl.
*A61H 1/00* (2006.01)

(52) U.S. Cl. ..... 601/31; 601/34

(58) Field of Classification Search ..... 601/5, 601/23, 24, 26, 33–35, 90, 93, 98, 101
See application file for complete search history.

(56) References Cited

U.S. PATENT DOCUMENTS 3,450,132 A 6/1969 Ragon et al.
4,487,199 A 12/1984 Saringer
4,492,222 A 1/1985 Hajianpour
4,520,827 A 6/1985 Wright et al.
4,522,205 A 6/1985 Taylor et al.
4,549,534 A 10/1985 Zagorski et al.
4,558,692 A 12/1985 Greiner
4,566,440 A * 1/1986 Berner et al. ..... 601/34
4,602,618 A 7/1986 Berze
4,603,687 A 8/1986 Greenwood
4,621,620 A 11/1986 Anderson
4,637,379 A 1/1987 Saringer
4,665,889 A 5/1987 Rumens et al.
4,665,899 A * 5/1987 Farris et al. ..... 601/33
4,671,257 A 6/1987 Kaiser et al.
4,798,197 A 1/1989 Nippoldt et al.
4,807,601 A 2/1989 Wright
4,825,852 A * 5/1989 Genovese et al. ..... 601/34
4,834,073 A * 5/1989 Bledsoe et al. ..... 601/34
4,930,497 A 6/1990 Saringer
5,228,432 A * 7/1993 Kaiser et al. ..... 601/34
5,239,987 A 8/1993 Kaiser et al.
5,252,102 A 10/1993 Singer et al.
5,255,188 A 10/1993 Telepko
5,273,520 A 12/1993 Rebmann
5,277,681 A 1/1994 Holt
5,280,783 A * 1/1994 Focht et al. ..... 601/34
5,303,716 A 4/1994 Mason et al.
5,399,147 A 3/1995 Kaiser
5,509,894 A 4/1996 Mason et al.
5,682,327 A 10/1997 Telepko
5,901,581 A 5/1999 Chen et al.
6,267,735 B1 7/2001 Blanchard et al.
6,325,770 B1 * 12/2001 Beny et al. ..... 601/34
6,673,028 B1 1/2004 Argenta et al.

* cited by examiner

*Primary Examiner*—Michael A. Brown
(74) *Attorney, Agent, or Firm*—Olive & Olive, P.A.

(57) ABSTRACT

An apparatus comprising: (a) a stationary base; (b) a drive assembly providing a drive member and means for reciprocating the drive member along a fixed linear path; (c) a femoral support extending between a first end connected to the base and a second end; (d) a tibial support extending between a first end connected to the second end of the femoral support and a second end; (e) a rigidly mounted, cantilevered femoral cradle slidably connected to the femoral support; (f) a rigidly mounted, cantilevered tibial cradle slidably connected to the tibial support; (g) a connecting member having an upper end connected to the tibial support second end and a lower end connected to the drive member; (h) a footrest structure mounted forwardly of the tibial cradle; and (i) the above elements arranged such that a person's leg is cyclically flexed and extended in response to reciprocation of said drive member.

22 Claims, 22 Drawing Sheets

APPARATUS AND METHOD FOR SUPPORTING AND CONTINUOUSLY FLEXING A JOINTED LIMB

FIELD OF THE INVENTION

The invention relates to an apparatus and method for supporting and continuously flexing a jointed limb; flexing of a leg and its knee joint being used by way of example.

BACKGROUND OF THE INVENTION

To avoid repetition of information, reference is made to the accompanying Information Disclosure Statement and to the prior art listed therein for background information.

DETAILED DESCRIPTION OF THE INVENTION

The apparatus provides means for supporting and continuously flexing a jointed limb of a person for a measured period of time during which the jointed limb is flexed and extended, and is illustrated by way of example with the jointed limb being that of a human leg, which is moved through a plurality of cycles of motion.

The apparatus comprises the following principal elements:

(a) a rigid femoral cradle slidably supported on, pivotally connected around a single axis, and cantilevered outwardly from the femoral support member and on which rest the femoral portion of the jointed limb being flexed;

(b) a rigid tibial cradle slidably supported on, pivotally connected around two axes, and cantilevered outwardly from the tibial support member and on which rest the tibial portion of the jointed limb being flexed;

(c) a control arrangement mounted on the femoral support member in a location readily accessible to the user;

(d) an adjustable foot support uniquely constructed and mounted on the cantilevered tibial cradle so as to be able to slide lengthwise and rotate around an axis transverse of the tibial support member in coordination with movement of the tibial-cantilevered cradle;

(e) an arrangement of pivotal and rotatable mounts which in conjunction with the cradles and foot support referred to above facilitate use of the apparatus on either right or left limbs; and (f) an arrangement which permits the upper and lower portions of a person's leg to be flexed while the respective leg portions remaining relatively stationary positions on respective slidable rigid cantilevered cradles.

Elements other than the principal elements referred to above will be described as the description proceeds.

Figure 1:
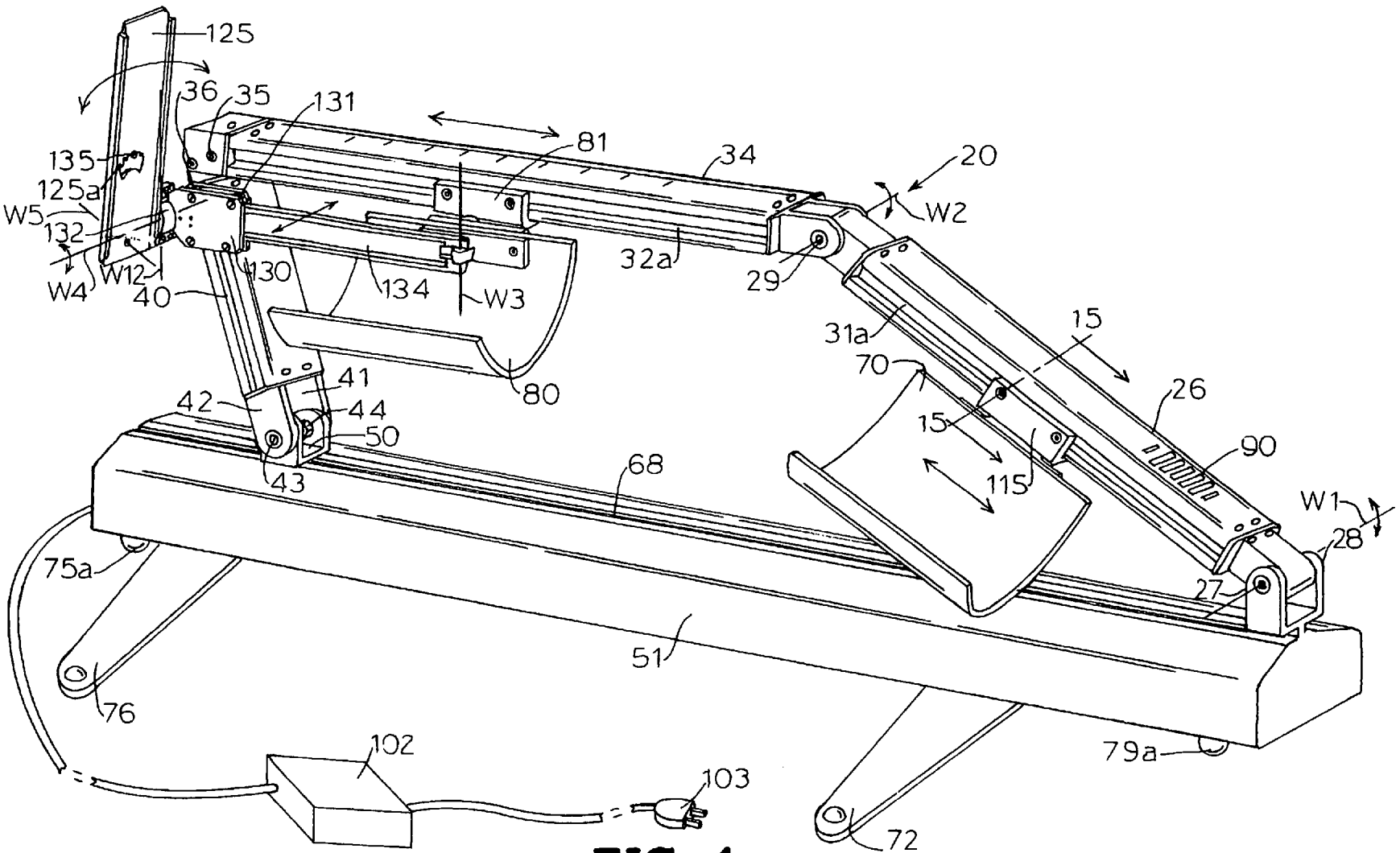
FIG. 1 is a perspective view of the apparatus showing cantilevered, slideably attached and rigid cradle supports arranged for receiving a right leg.

Referring initially to FIG. 1, the apparatus 20 includes a main structural support element defined as a base element 21. The femoral support member 26 has its lower end pivotally mounted by means of a pin 27 to the upper V-shaped end of a femoral base element attachment member 28 whose lower end is fixedly attached to the base element 21. The upper end of the femoral support member 26 is pivotally linked by means of a pin 29 to the trailing end of tibial support member 34. The leading end of tibial support member 34 is fixedly mounted by means of pins 35 and 36 onto the upper end of tibial base element attachment member 40. The lower end of the tibial base element attachment member 40 is in turn formed with a pair of opposed mounting arms 41 and 42 which are pivotally attached via axially aligned pins 43 and 44 to driving element 50. W1 is the axis about which the femoral support member 26 rotates in relation to femoral base element attachment member 28. W2 is the axis of rotation about pin 29 in the connection between the femoral support member 26 and the tibial support member 34 wherein apparatus 20 extends and contracts.

Figure 2:
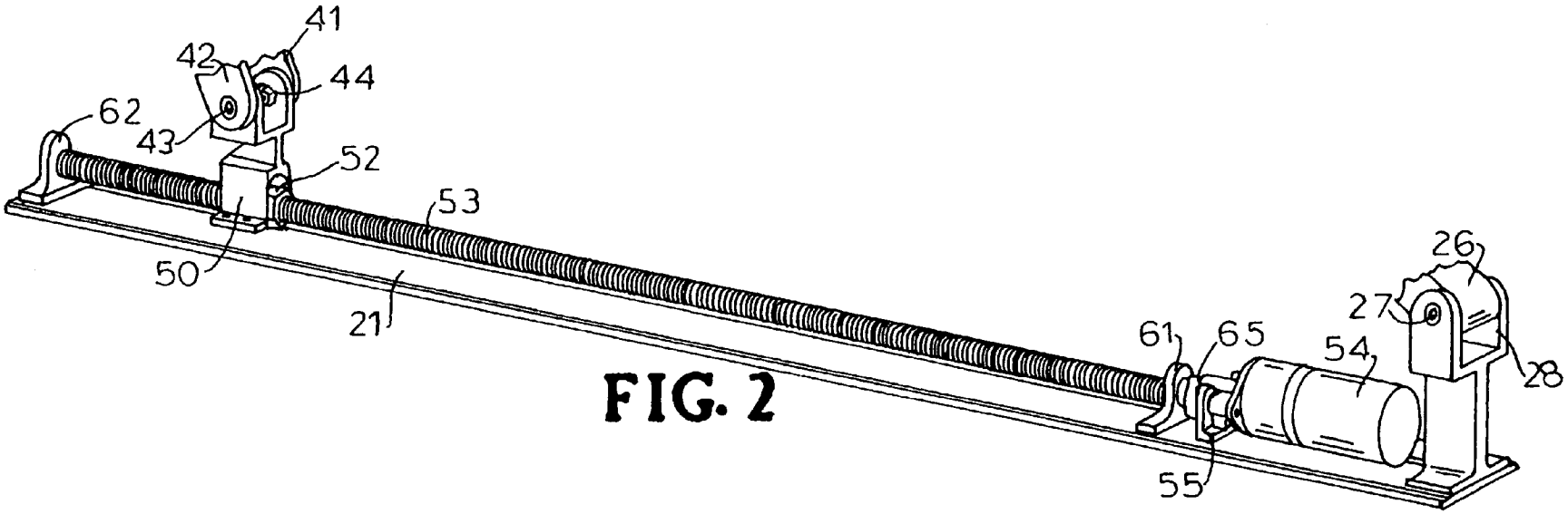
FIG. 2 is a fragmentary view of the drive portion of the apparatus of FIG. 1 with the housing cover of the base unit removed to show the motor and associated drive elements of the apparatus.

FIG. 2, showing the drive mechanism with housing cover 51 removed, illustrates driving element 50 mounted via an internally threaded nut 52 onto drive screw 53. Driving element 50 is designed to move in both directions along the linear path of drive screw 53, by operation of reversible motor 54, in accordance with programmed input. The rotary motion of the drive screw 53 as generated by the motor 54 leads to both linear displacement of nut 52 and movement of driving element 50 along its linear path. Drive screw 53 is part of a drive mechanism that comprises both drive screw 53 and reversible motor 54. Drive screw 53 is mounted for rotation about its longitudinal axis at the posterior end of the apparatus 20 by a rear bearing support 61 and at the anterior end of the apparatus by a forward bearing 62. The drive screw 53 is linked through a flexible coupling 65 to reversible motor 54. Reversible motor 54 is supported at one end by motor support 55 and also by its mounting to the base element 21.

Figure 3:
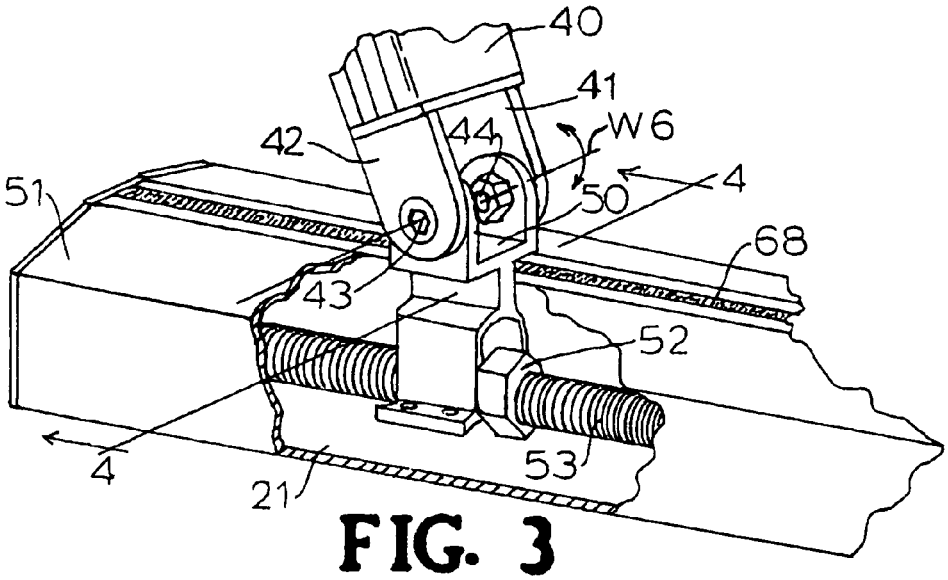
FIG. 3 is an enlarged fragmentary view of the drive elements mounted via an internally threaded nut onto a drive screw.
Figure 4:
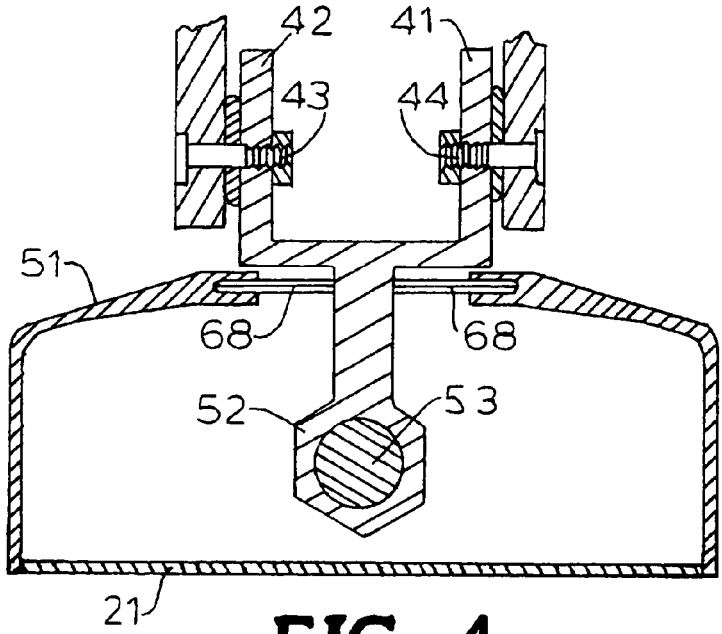
FIG. 4 is a cross sectional view taken in the direction of line 4-4 of FIG. 3 to show the drive elements.

FIGS. 3 and 4 show the drive mechanism as contained within the housing cover 51, and in the embodiment as illustrated in FIG. 1 with a slotted brush screen 68 which allows the driving element 50 to move along the length of drive screw 53. W6 is the axis of rotation about which tibial base element attachment member 40 and its mounting arms 41 and 42 rotate in their connection with driving element 50 during contraction and extension of apparatus 20.

Figure 5:
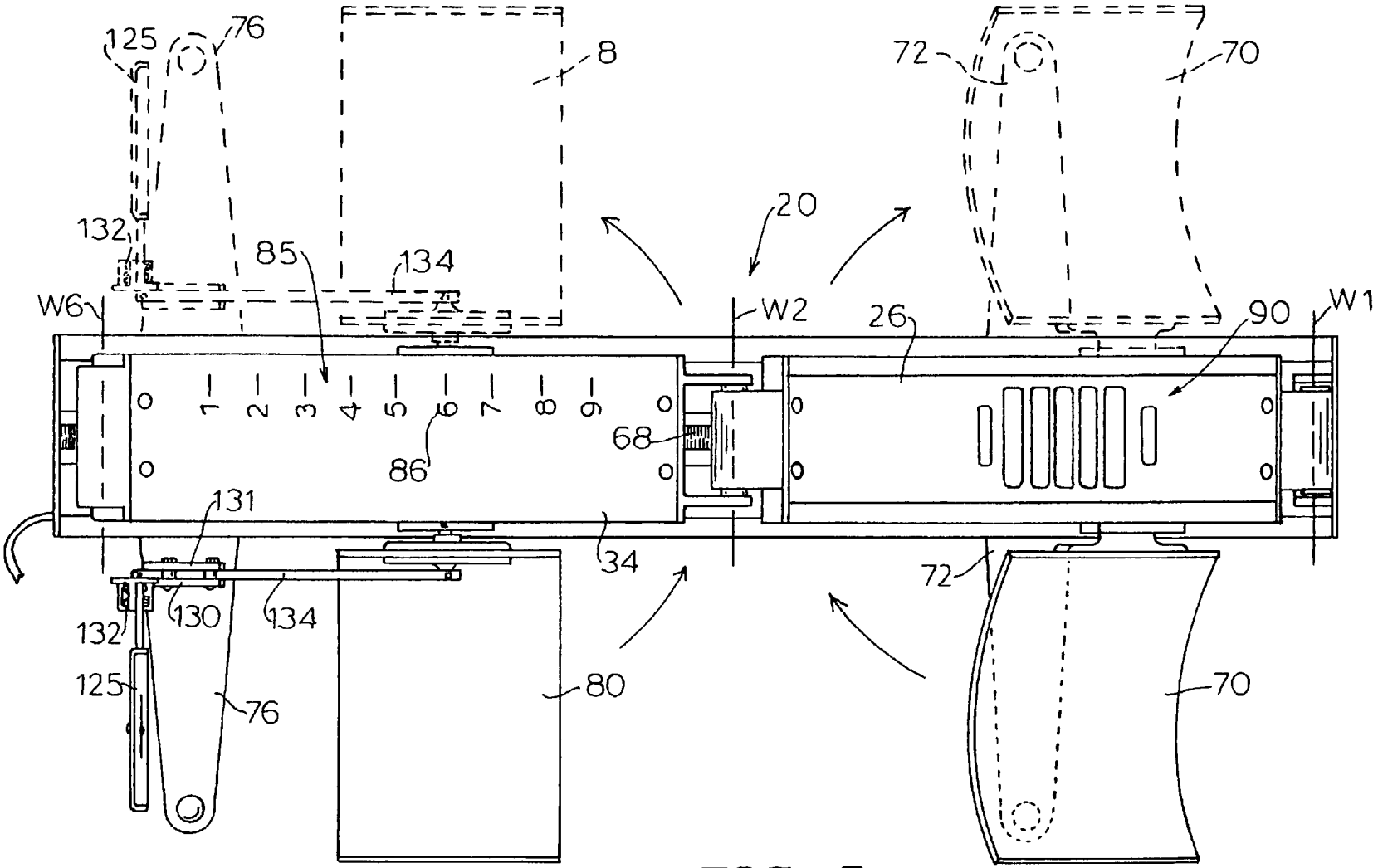
FIG. 5 is a top plan view of the apparatus of FIG. 1 showing the apparatus (in solid lines) when in its fully extended position and with the apparatus set up for flexing a person's right leg and (in dashed lines) when in its fully extended position with the apparatus set up for flexing a person's left leg.
Figure 6:
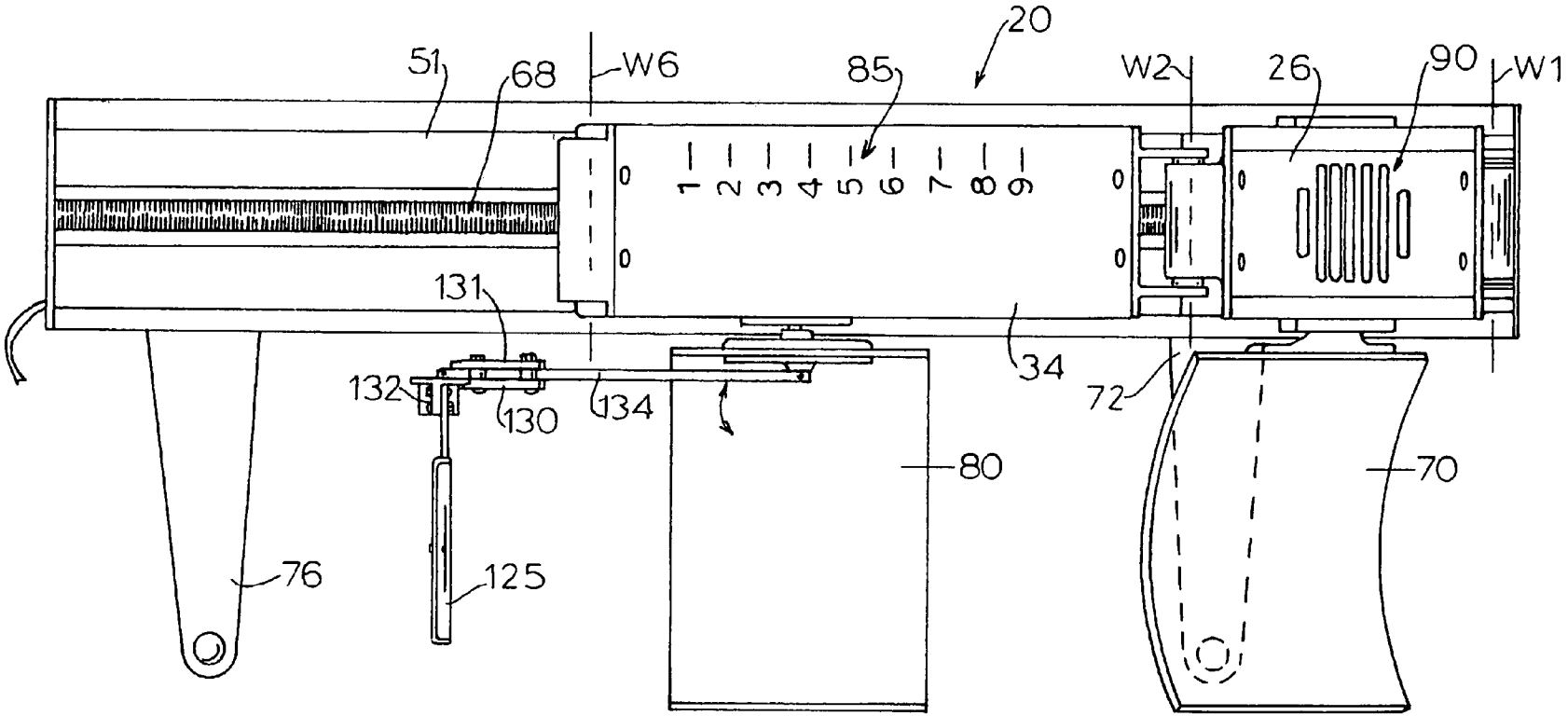
FIG. 6 is a top plan view of the apparatus of FIG. 5 when in its contracted position and set up for flexing a person's right leg.

FIGS. 5 and 6 illustrate, in top plan views of the apparatus, the transition from a fully extended position as in FIG. 5 to a contracted position as in FIG. 6. The solid lines in FIG. 5 for the femoral-cantilevered cradle 70 and the tibial-cantilevered cradle 80 illustrate the set-up for receiving a person's right leg and the dashed lines illustrate the set-up when the femoral-cantilevered cradle 70 and the tibial-cantilevered cradle 80 are rotated 180 degrees to the other side of the apparatus 20 for receiving a person's left leg. Also illustrated in FIGS. 5 and 6 are the stabilizing arms 72 and 76 which are mounted so as to be able to rotate 180 degrees to the other side of the apparatus 20 depending on which side the femoral-cantilevered cradle 70 and tibial-cantilevered cradle 80 are located. Stabilizing arms 72 and 76 are shown in FIG. 5 in solid lines for supporting the apparatus 20 when it is positioned for receiving a person's right leg and are shown in dotted lines in FIG. 5 when they are rotated to the other side in correspondence with the apparatus being positioned for supporting a person's left leg. FIG. 5 also shows a graduated scale 85 located on the top of the tibial support member 34. The graduated scale 85 is used for measurement of the length of a person's leg and based on the gradation number 86 being for example 6 (see FIG. 9) and corresponding to the person's leg size, that gradation number 86 (FIG. 9) is input as one of a set of input control numbers (FIG. 9) into the control panel 90 which is displayed on the top of the femoral support member 26, as seen in FIGS. 5 and 6.

Figure 7:
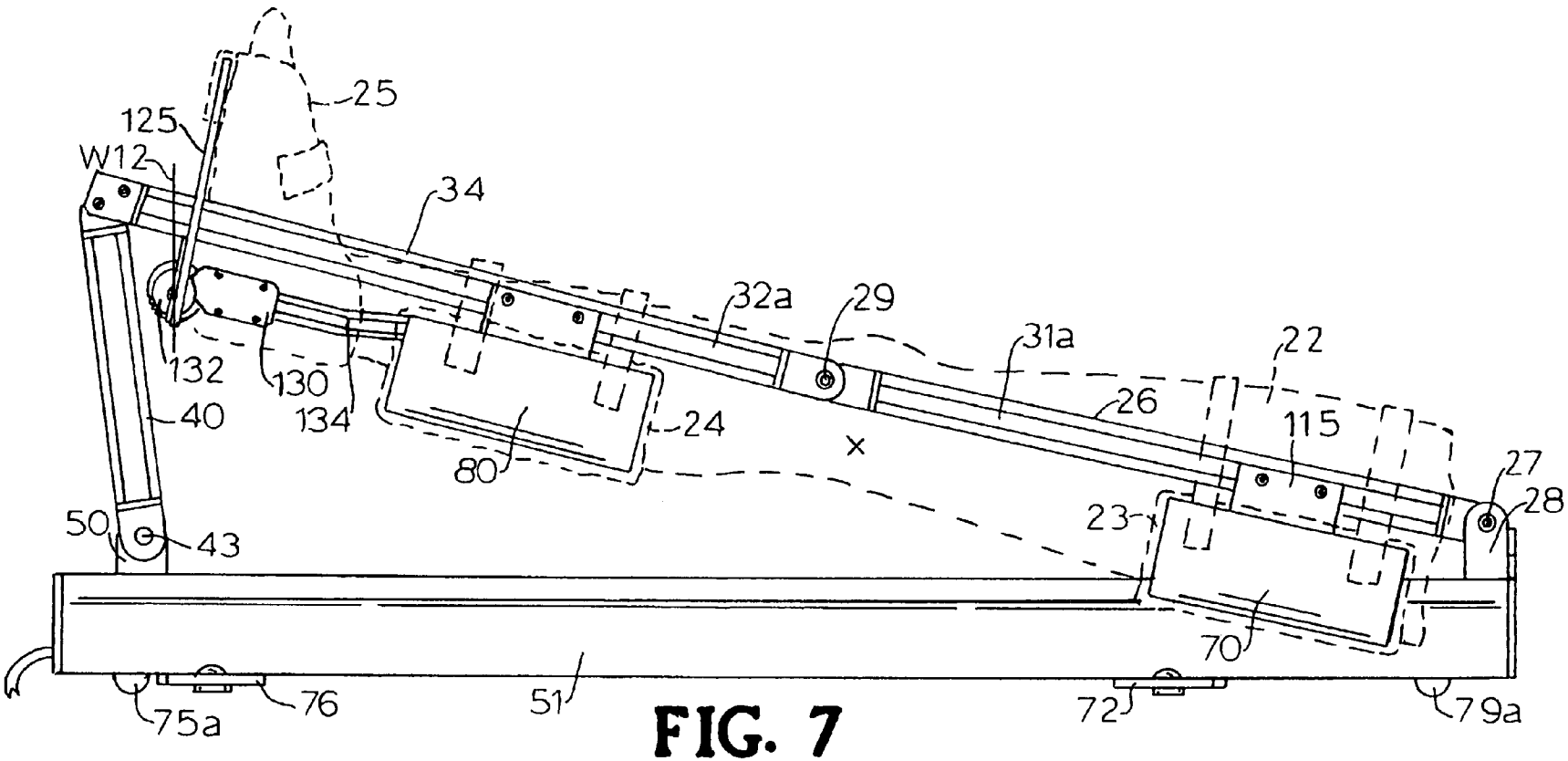
FIG. 7 is a side elevation view of the apparatus of FIG. 5 showing in dashed lines the placement of a person's upper and lower right leg in respective corresponding cantilevered cradles when the apparatus is in its fully extended position.
Figure 8:
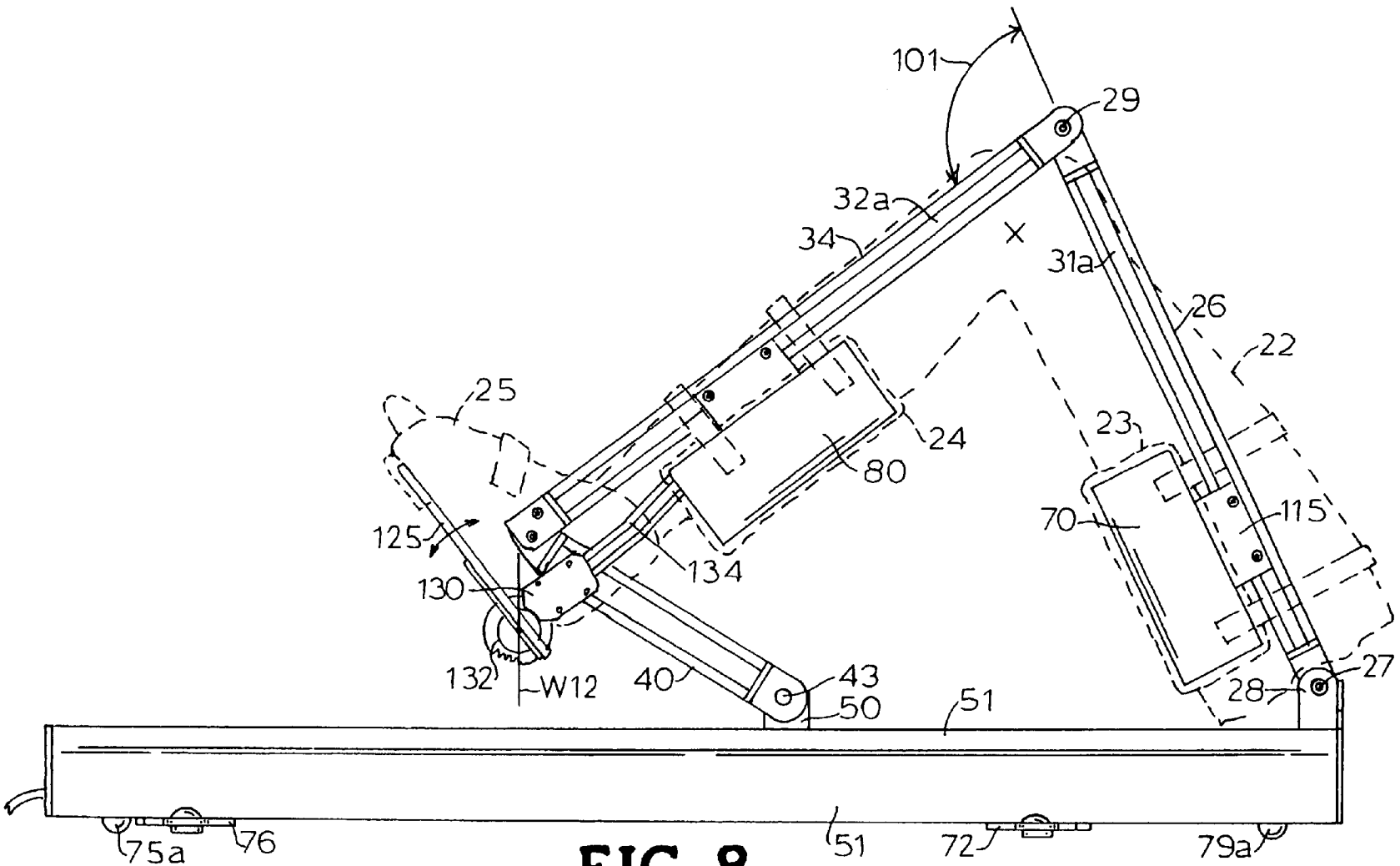
FIG. 8 is a side elevation view of the apparatus of FIG. 6 showing in dashed lines the placement of a person's upper and lower right leg in respective corresponding cantilevered cradles when the apparatus is in the contracted position.

FIGS. 7 and 8 illustrate side views of the apparatus 20 supporting and flexing a person's right leg 22, which is shown in dotted lines. As illustrated in FIGS. 7 and 8, both the femur and tibia of the patient are firmly held on the rigid femoral-cantilevered and tibial-cantilevered cradles 70 and 80 respectively, through the use of a soft covering such as sheepskin cushions 23 and the foot is held in place similarly with the use of a sheepskin cushion. FIG. 7 shows the apparatus 20 at full extension and FIG. 8 shows the apparatus 20 when contracted. In both figures it should be noted that the axis of rotation about the person's knee joint, illustrated by an "x" in both FIGS. 7 and 8, does not need to coincide with the pivotal axis of the apparatus 20, which is the pivotal connection of the femoral support member 26 and the tibial support member 34 located at pin 29. Once a patient's limb is set according to the appropriate gradation number 86, for example 6 as in FIG. 9, the microprocessor 91 (FIG. 9) ensures that this relationship of the patient's limb to the apparatus 20 is kept constant throughout its operation. In this way, the patient's knee is not compelled to follow the pivot of the apparatus 20 but instead follows its natural pivot point, and thereby avoids undue resistance and residual stress on the jointed limb. Apparatus 20 initially starts in its extended position as depicted in FIG. 7 and from such position driving element 50, during flexion, initially is driven towards motor 54. This produces an increasingly acute angular rotation, herein referred to as "negative rotation," of tibial support member 34 as shown in FIG. 8, and consequently also of tibial-cantilevered cradle 80. Simultaneously, this negative rotation of tibial support member 34 produces a positive rotation, of the femoral support member 26, and consequently of femoral-cantilevered cradle 70. This in turn causes both an upward force to be applied to the upper leg and a downward force to be applied to the lower leg simultaneously and thereby the jointed limb flexes. When moving towards extension, as shown in FIG. 7, the reverse occurs; wherein the tibial support member 34 is positively rotated while the femoral support member 26 is negatively rotated. Appropriately, when apparatus 20 is moving towards limb extension, negative rotation of the femoral-cantilevered cradle 70 and positive rotation of the tibial-cantilevered cradle 80 causes both downward force on the upper leg and upward force on the lower leg to occur simultaneously and thereby the jointed limb extends. It should be noted that rendering upward force on the femoral-cantilevered cradle 70 and simultaneously rendering downward force on tibial-cantilevered cradle 80 while allowing femoral-cantilevered cradle 70 to slide as necessary along tracks 31*a* (FIG. 1) and 31*b* (hidden in FIG. 1) and allowing tibial-cantilevered cradle 80 to both slide along tracks 32*a* (FIG. 1) and 32*b* (hidden in FIG. 1) and rotate about a pivot axis as necessary in order to achieve limb flexion avoids the possibility of applying forces to the tibia that would cause it to move in an anterior direction relative to the femur (or anterior tibial translation), and thereby prevents undue stress on the anterior cruciate ligament (ACL).

Figure 9:
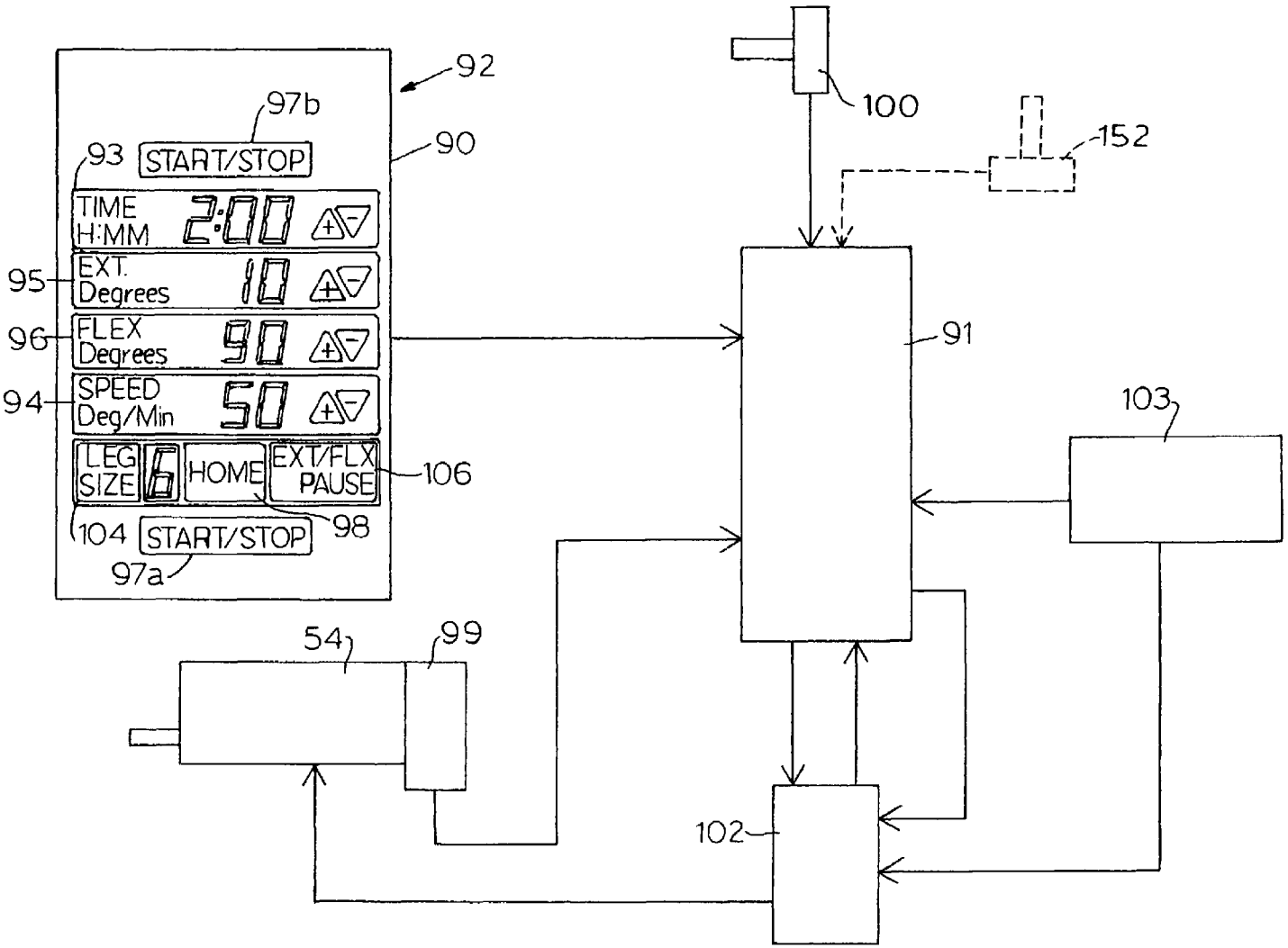
FIG. 9 is a block diagram of the overall control system for the apparatus of FIG. 1.

FIG. 9 is the block diagram of the control system for the apparatus 20. The contemplation of the present invention can involve a variety of electronics to provide input to the motor 54. However, it is to be understood that this programmed input and the related electronics necessary for its use can be of any type that is capable of causing the drive screw 53 to rotate in a specified direction at a specified speed in coordination with controlling the amount of time the apparatus 20 operates, the degree of extension and contraction and according to the size of the leg of the person using the apparatus 20. The electronic control system 92 illustrated by way of example consists of a user interface which in the preferred embodiment is a control panel 90 with user push button input and LED display, located on the top wall of femoral support member 26. Control panel 90 allows the user to input various control options which are then sent to microprocessor 91. In the control system 92, being used by way of example, the user can set the following input controls on control panel 90: time 93, speed 94, extension angle 95 and flexion angle 96. In addition, two start/stop buttons 97*a* and 97*b* allow multiple access and control to start or stop the apparatus 20, as well as a home button 98 to direct the apparatus 20 to fully extend and an extension pause button 106 to pause the apparatus 20 during the contraction or extension phase of its cycle. Microprocessor 91 monitors motor shaft encoder 99 to detect motor speed, motor current to detect load, and a potentiometer resistance to detect flexion angle 96 and extension angle 95. A femoral angle input potentiometer 100, mounted in the pivotal connection between femoral support member 26 and attachment member 28, provides a resistance signal which is used to control the angle of contraction or flexion angle 101 of apparatus 20 (i. e., the angle measured by the extension of femoral support member 26 to the tibial support member 34, as seen in FIG. 8). Microprocessor 91 controls motor speed by varying the duty cycle of a 20 kilohertz, 5 volt pulse sent to motor controller 102. Microprocessor 91 also controls direction by sending a high (i.e., +5 volt) or low (i.e., 0 volt) signal to motor controller 102, which changes the direction of driving element 50 at the appropriate time by monitoring the potentiometer resistance from the femoral angle input potentiometer 100. Microprocessor 91 also keeps time for the session and can be used, in the preferred embodiment, in a count down mode, but in alternate embodiments it can keep time in a count up mode. In the count down mode microprocessor 91 will stop the motion when time reaches zero. Electronic control system 92 is powered by power supply 103 which supplies power to motor controller 102, motor shaft encoder 99, reversible motor 54 and microprocessor 91. In an alternate embodiment, tibial angle input potentiometer 152 (see FIGS. 9 and 19) sends a signal to microprocessor 91 based on the rotation of cradle 80 around axis W9 corresponding to the patient's knee angle. Tibial angle input potentiometer is added as an alternate means of calculating the knee angle as opposed to inputting the patient's leg size as measured on graduated scale 85 (see FIG. 6).

Figure 10:
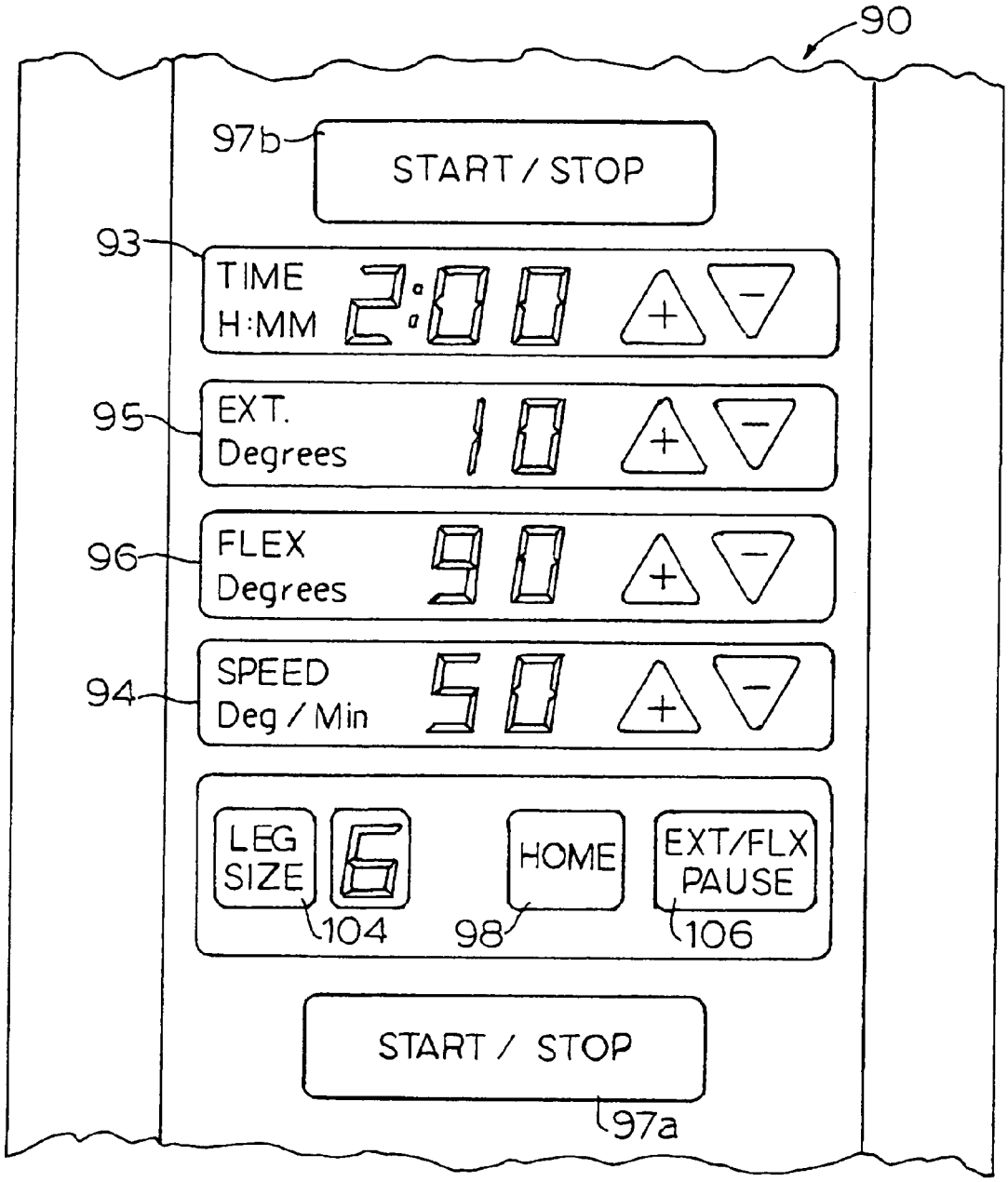
FIG. 10 is an enlarged fragmentary plan view of the control panel seen in FIG. 9 and which in FIGS. 1 and 5 is shown mounted on the femoral support member of the apparatus.

FIG. 10 is an enlarged fragmentary plan view of control panel 90 which a patient or attendant can use to program various input parameters to adjust apparatus 20 to the patient's needs via touch pad controls. Other means of inputting the data are also envisioned for use on the apparatus 20. Input parameters, by use of example, include time 93 in units of h:mm, extension angle 95 in degrees, flexion angle 96 in degrees, and speed 94 in terms of degrees/minute. Control panel 90 also has a leg size touch pad 104 for inputting the patient's leg size according to the gradation number 86 (for example 6 as shown in FIG. 10) corresponding to the patient's leg size as measured against the graduated scale 85 on the top side of femoral support member 26 (FIG. 5). Also included in this embodiment of the control panel are dual start/stop touch pads 97*a* and 97*b* to permit the patient or attendant to start or stop the apparatus 20 as well as a extension/flex pause touch pad 105 to direct the apparatus 20 to pause in the extension/flex direction and also a home touch pad 98 to cycle the apparatus 20 to assume the home position, which is the fully extended position. With each unique patient, the actual angular relationship between the tibia and the femur during operation may differ from the corresponding angular relationship between the femoral support member 26 and the tibial support member 34. Therefore, in operation of apparatus 20, it is necessary to know the relationship between these two angles, herein defined as flexion angle 101 so that a limiting angle may be specified in the programmed input. Flexion angle 96 is the angle created from the imaginary line drawn from the extension of the femoral support member, measured to the tibial support member 34 and is illustrated in FIG. 8.

Figure 11A:
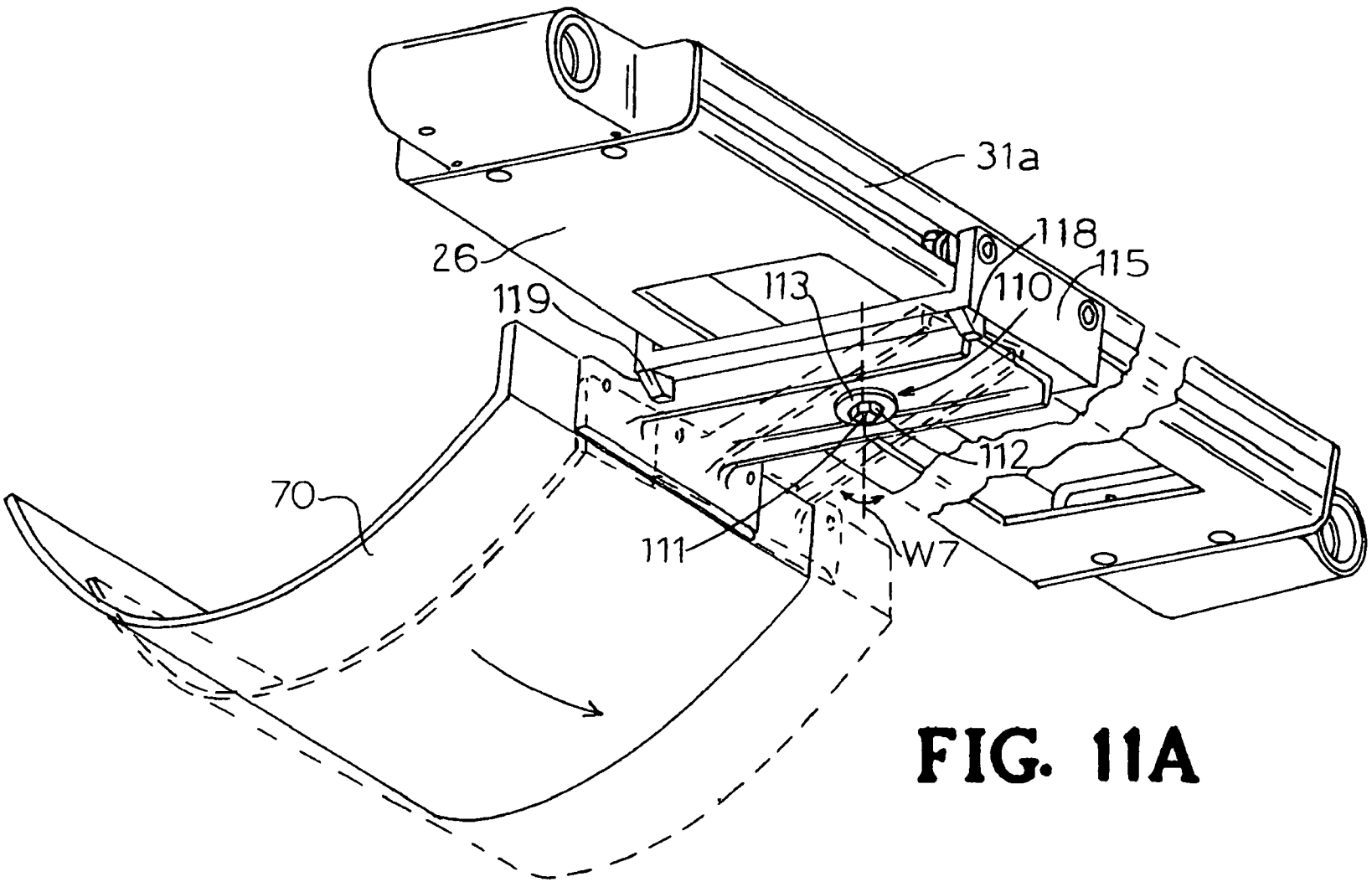
FIG. 11A is a bottom perspective view of the femoral-cantilevered cradle and slide attachment to the femoral support member and illustrated for use by a person's upper right leg, and in dashed lines at the start of being rotated to the other side of the femoral support member for receiving a person's left leg.
Figure 11B:
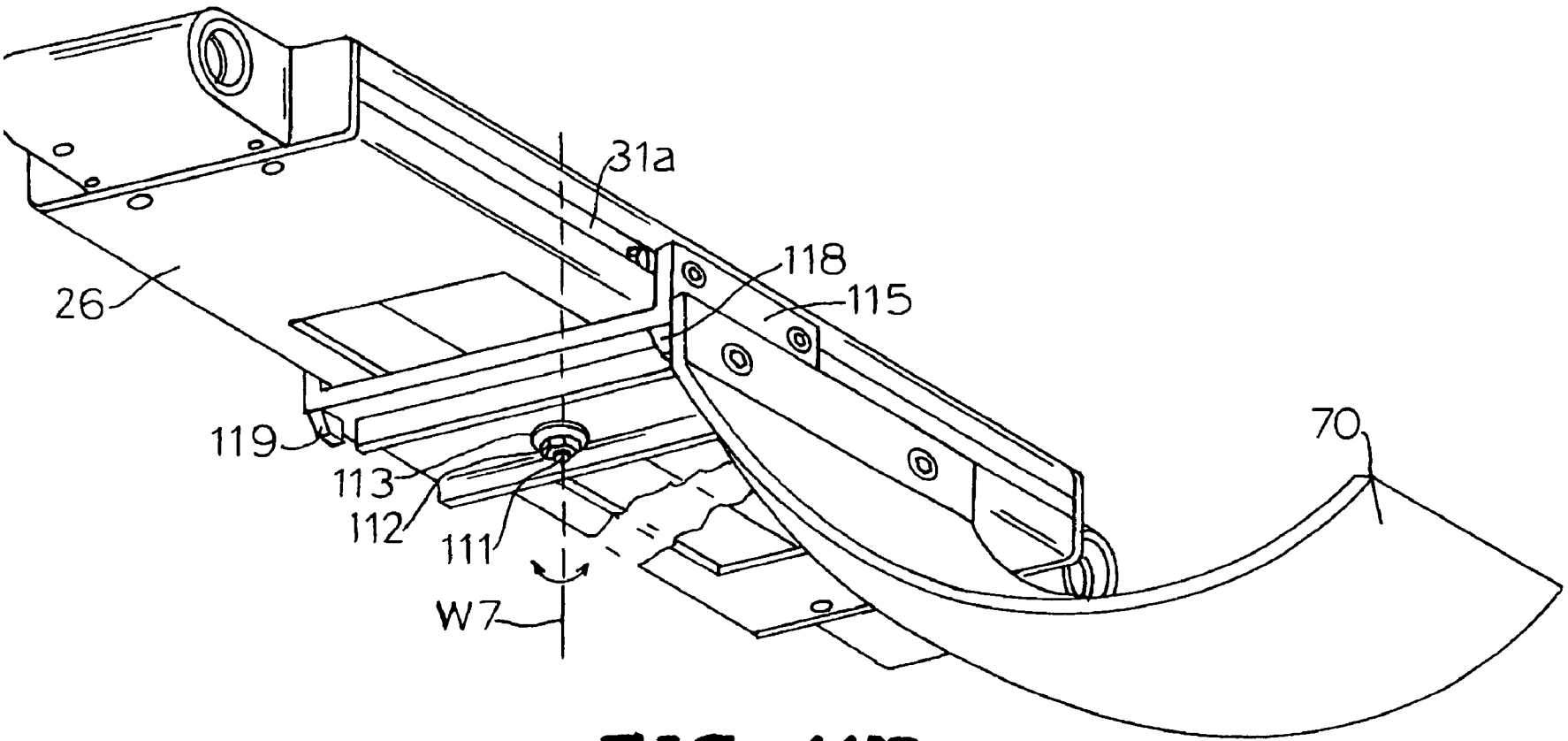
FIG. 11B is a bottom perspective view showing the femoral-cantilevered cradle of FIG. 11A after being positioned for receiving a person's upper left leg.
Figure 15:
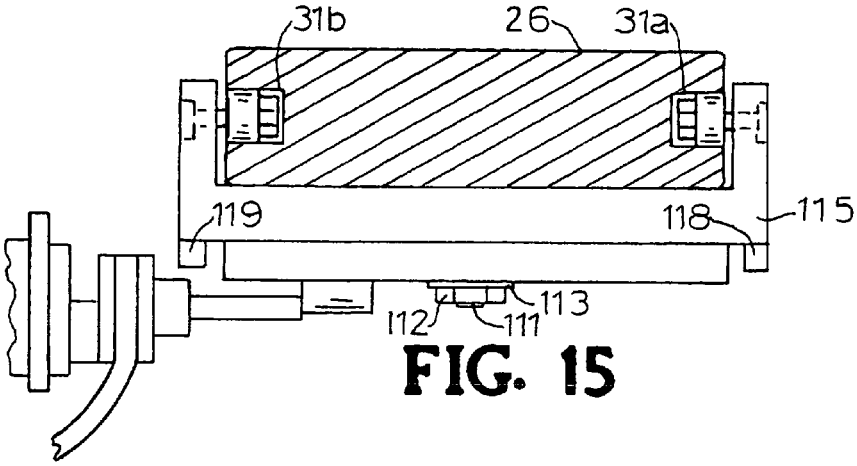
FIG. 15 is a partial section view taken along line 15-15 of FIG. 1 of the slide mechanism for the femoral-cantilevered cradle.

FIGS. 11A and 15 illustrate how femoral-cantilevered cradle 70 for upper limb support is attached to the femoral support member 26 by means of a pivot and attachment assembly 110 via bolt 101, nut 102 and washer 103, allowing femoral-cantilevered cradle 70 to rotate 180 degrees about axis W7 to the other side of femoral support member 26. Axis W7 is perpendicular to the plane of the bottom surface of femoral support member 26. Femoral-cantilevered cradle 70 also is attached via the pivot and attachment assembly 110, bolt 101 nut 102 and washer 103 to femoral slide mechanism 115. Femoral slide mechanism 115 slides along tracks 31*a* and 31*b* by means of bolts 116*a*, 116*b* (not seen) 116*c*, 116*d* (not seen), and nuts 117*a*, 117*b* (not seen), 117*c*, and 117*d* (not seen), allowing femoral-cantilevered cradle 70 to slide lengthwise alongside of and along a path parallel to and outwardly of femoral support member 26. FIG. 11A illustrates the femoral-cantilevered cradle 70 for receiving a right upper limb and its dashed lines illustrate how femoral-cantilevered cradle 70 can start its rotation of 180 degrees clockwise about axis W7 to the other side of femoral support member 26, shown in FIG. 11B, where it is set to receive a left upper limb. Femoral cradle stops 118 and 119 stop the rotation of femoral-cantilevered cradle 70 from rotating freely around 360 degrees of rotation. FIG. 11B illustrates femoral-cantilevered cradle 70 of FIG. 11A after rotation 180 degrees about axis W7 and in place for receiving a left upper leg.

Figure 12A:
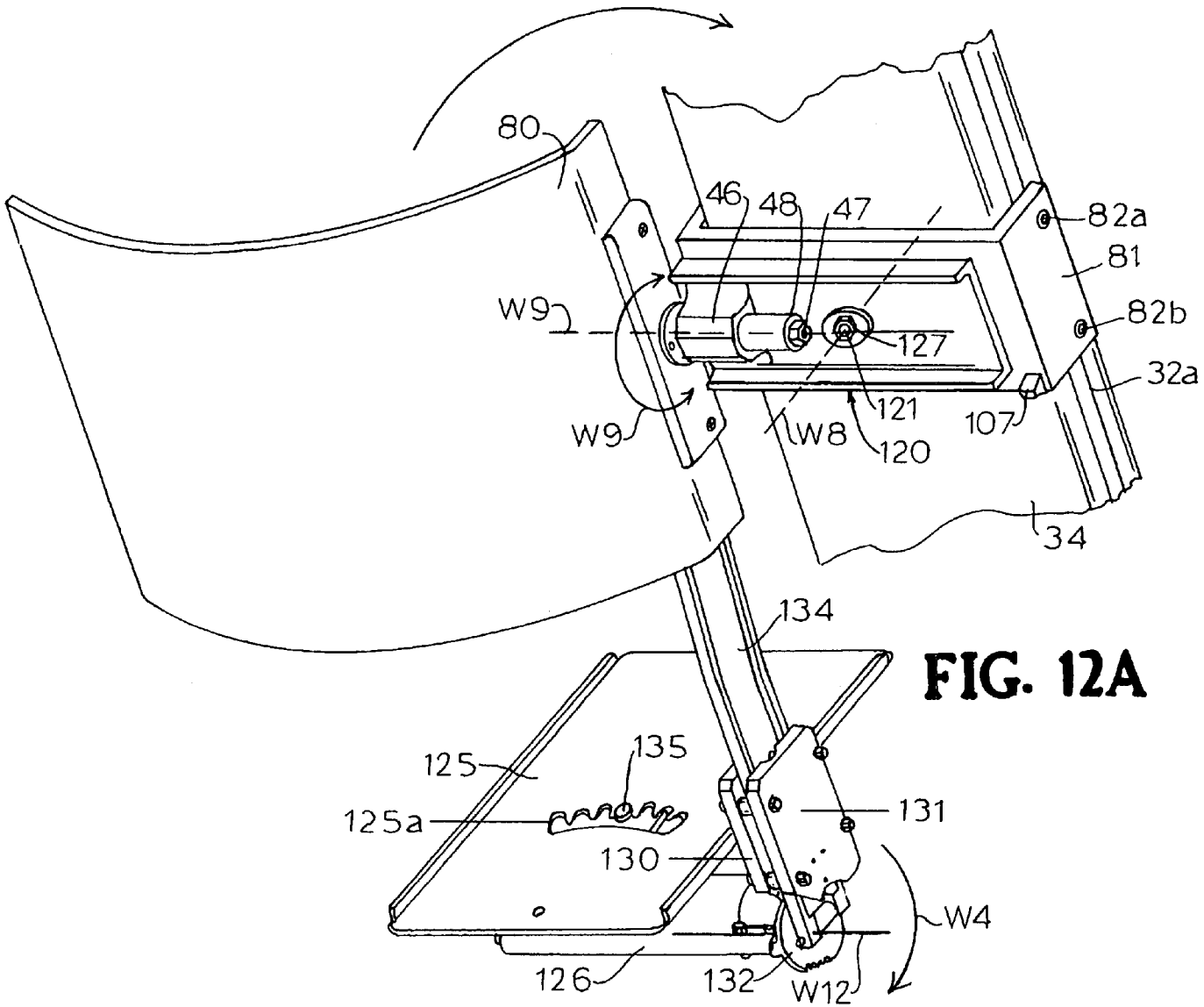
FIG. 12A is a bottom perspective view of the tibial-cantilevered cradle and slide attachment as well as the foot support with swivel attachment and illustrated in position for receiving a person's lower right leg and right foot.

FIG. 12A illustrates how tibial-cantilevered cradle 80 is attached to tibial support member 34 by means of pivot and attachment assembly 120 via bolt 121 and nut 122 allowing the cradle to rotate 180 degrees about axis W8 to the other side of tibial support member 34 as shown in FIGS. 12A through 12E. Axis W8 is perpendicular to the plane of the bottom surface of tibial support member 34. In addition, pivot and attachment assembly 120 allows tibial-cantilevered cradle 80 to pivot about axis W9. Axis W9 is parallel to the plane of the bottom surface of tibial support member 34. In FIG. 12A, the tibial-cantilevered cradle 80, footplate 125 and related assembly are positioned for receiving a patient's lower right leg and foot. Tibial-cantilevered cradle 80 is attached via pivot and attachment assembly 120, bolt 121 and nut 122 to tibial slide mechanism 81 allowing rigid tibial-cantilevered cradle 80 to slide lengthwise alongside of and along a path parallel to and outwardly of tibial support member 34 along slide tracks 32*a* and 32*b*. Bolts 82*a*, 82*b*, 82*c* (not shown), and 82*d* (not shown) and nuts 83*a*, 83*b*, 83*c*, and 83*d* (not shown) position the tibial slide mechanism 81 within tracks 32*a* and 32*b* which allows for unrestricted reciprocal movement of the tibial-cantilevered cradle 80 along slide track 32*a* and 32*b*. This mounting and sliding mechanism while not illustrated is like that illustrated in FIGS. 11A and 15 for rigid femoral-cantilevered cradle 70. Tibial-cantilevered cradle 80 is rotatably attached to pivot and attachment assembly 120 via coupling 46, bolt 47 and spacer 48 and rotates about axis W9. This rotating attachment of tibial-cantilevered cradle 80 about axis W9 allows for infinite adjustment of the patient's lower leg during contraction and extension. When a patient puts their lower leg into tibial-cantilevered cradle 80, apparatus 20 allows for adjustment of footplate 125 by rotatably moving footplate support member 126 around a 360 degree arc around axis W4. By pulling plates 130 and 131 away from the ratcheting cog assembly 132 by a spring loaded mechanism (illustrated in FIGS. 12E, 13 and 14) the patient or attendant is able to rotate footplate support member 126 and footplate 125 in a 360 degree arc around axis W4. This allows for adjustment of the forward-rearward angle of the patient's foot/ankle. Another adjustment of the foot/ankle area is accomplished by adjusting the side-to-side position of the foot/ankle by moving the footplate 125 onto various footplate openings 132 around axis W5 and then locking the selected opening onto screw 135. Once the proper angle of footplate 125 is situated to the satisfaction of the patient, one can then release plates 130 and 131, thereby locking the adjustment in place on the appropriate ratchet position of ratcheting cog assembly 132. In summary, the tibial-cantilevered cradle 80 and associated footplate attachment member allow for infinite adjustment of the patient's lower leg by the following mechanisms: (1) slideably allowing for differences in dimension of a person's lower leg and adjustments during contraction and extension through tibial slide mechanism 81; (2) rotatably adjusting about axis W9 for variations in supporting a person's lower leg during contraction and extension via pivot and attachment assembly 120; (3) rotatably adjusting about axis W4 for various forward-rearward foot/ankle angles via ratcheting cog assembly 132; and (4) adjusting for various side-to-side foot/ankle angles by adjusting footplate 125 about axis W5 onto various footplate openings 125*a* and locking the selection onto screw 135.

Figure 12B:
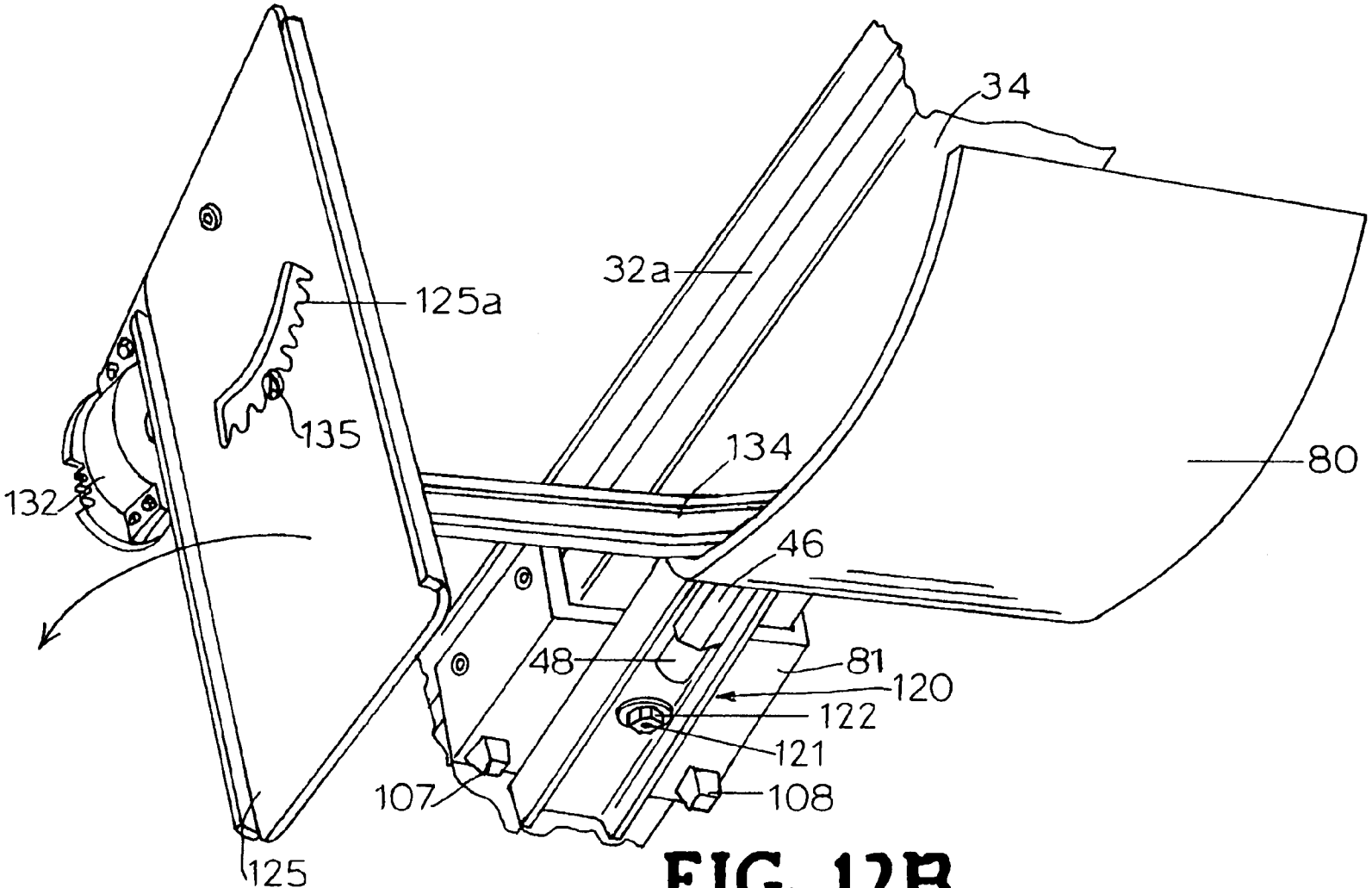
FIG. 12B is a bottom perspective view of the tibial-cantilevered cradle assembly of FIG. 12A illustrating the first stage of the transition of the tibial cradle to the other side of the tibial support member wherein the footplate is rotated downward and the tibial cradle is rotated partway underneath the tibial support member.

FIG. 12B illustrates how tibial-cantilevered cradle 80 is pivotally linked to sliding mount 81 via pivot and attachment assembly 120 so that tibial-cantilevered cradle 80 is able to rotate clockwise 180 degrees around the axis of pivot and attachment assembly 120 and nut 127 and bolt 121 and stop via tibial cradle stops 107 and 108. Footplate 125 and footplate support member 126 are rotated 180 degrees downward so that they can clear tibial support member 34 during the 180 degree rotation of tibial-cantilevered cradle 80 to the other side of tibial support member 34.

Figure 12C:
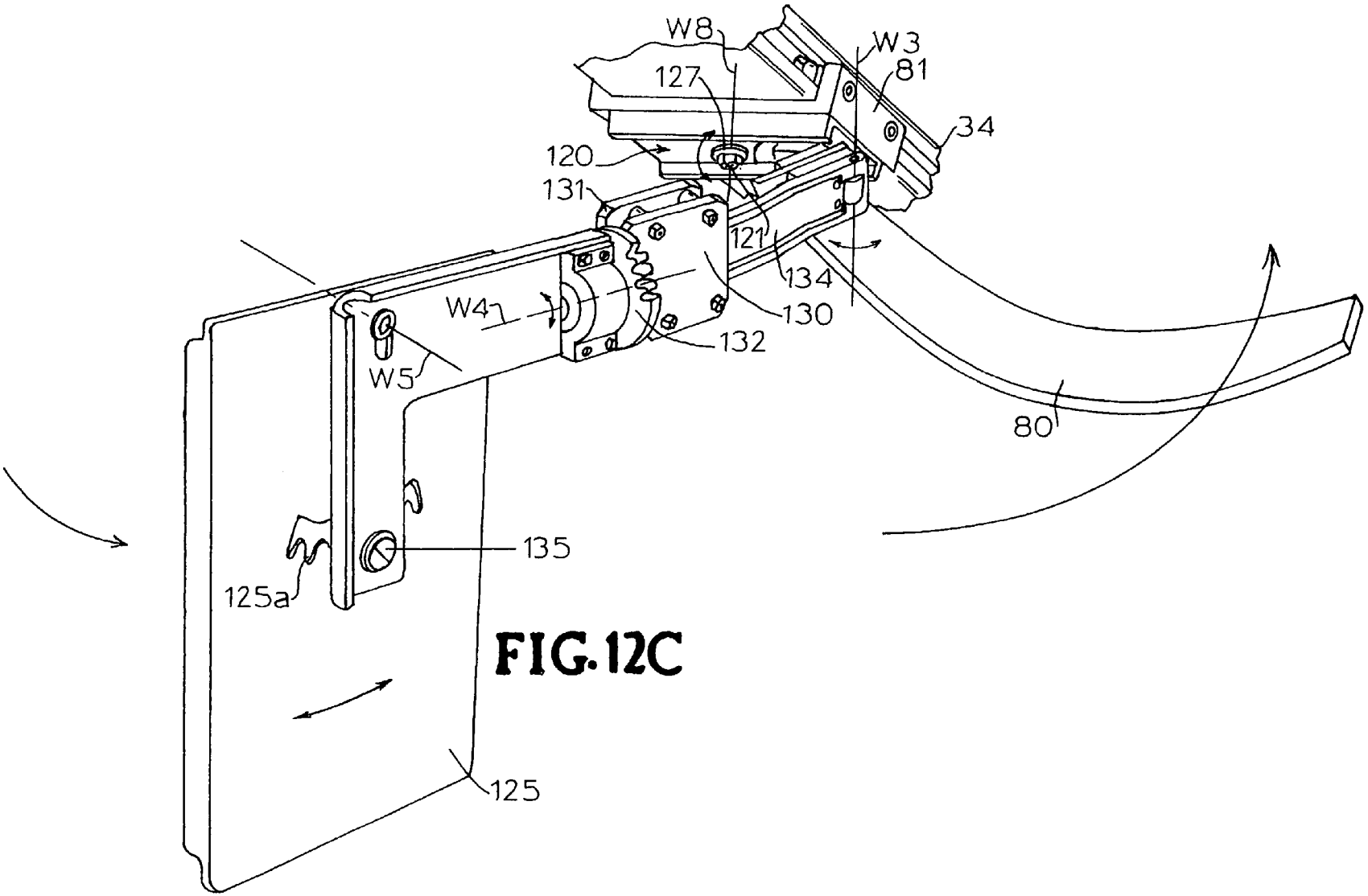
FIG. 12C is a bottom perspective view of the tibial-cantilevered cradle assembly of FIG. 12A illustrating the second stage of rotation of the tibial cradle during which the tibial cradle is rotated 180 degrees and positioned for receiving a lower left leg and with the foot plate set to swivel 180 degrees to the other side of the tibial cradle.

FIG. 12C illustrates how footplate attachment member 134 is rotated 180 degrees on axis W3 around tibial-cantilevered cradle 80 so that it can be in position for receiving a patient's left foot after the transition to the other side. Tibial-cantilevered cradle 80 is now locked in position via tibial cradle stops 107 and 108.

Figure 12D:
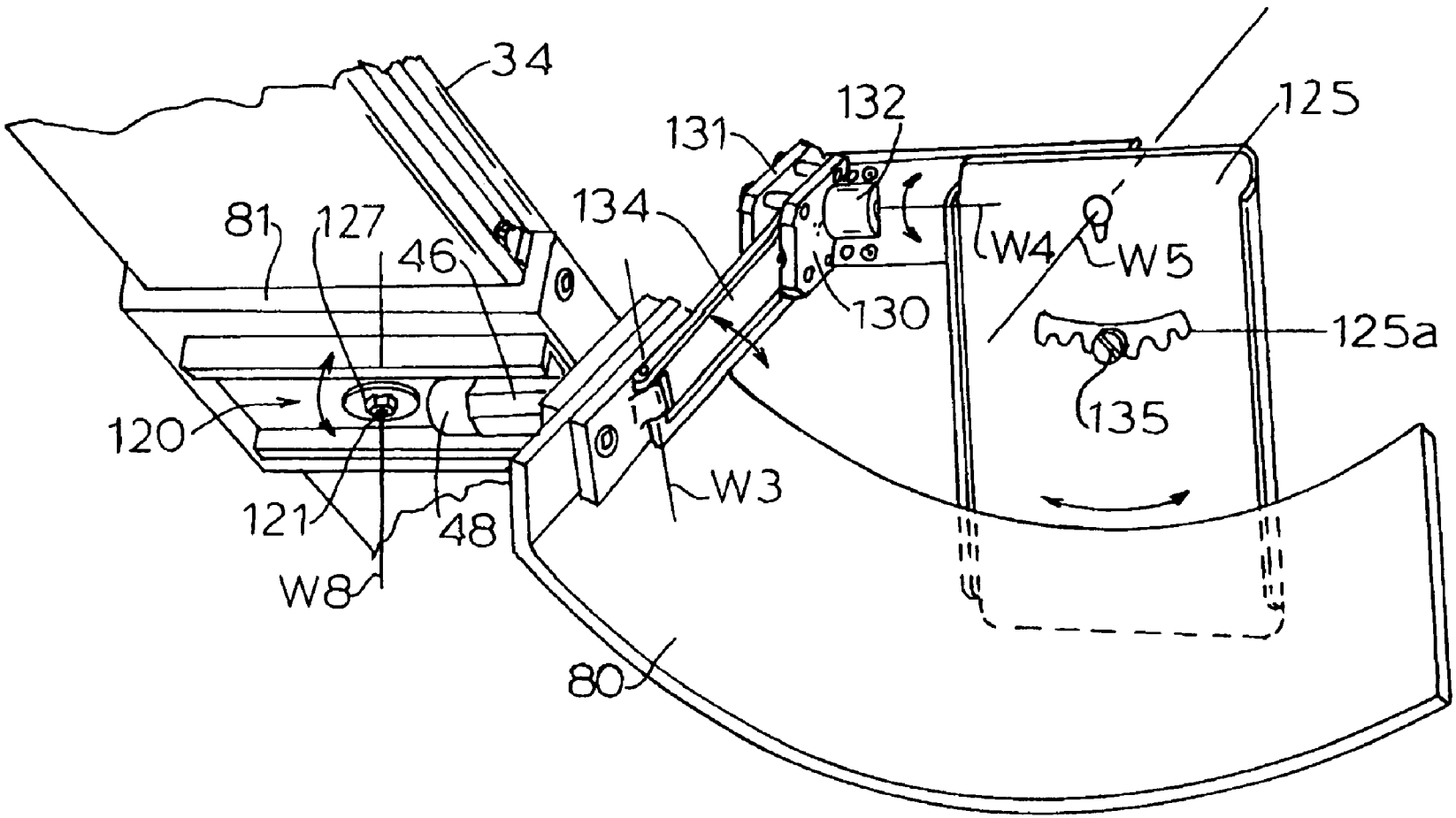
FIG. 12D is a bottom perspective view of the tibial-cantilevered cradle assembly of FIG. 12A showing the third stage of rotation of the tibial cradle to the other side of the tibial support member wherein the footrest attachment member has been rotated 180 degrees to the other side of the tibial cradle to receive a person's left foot.
Figure 12E:
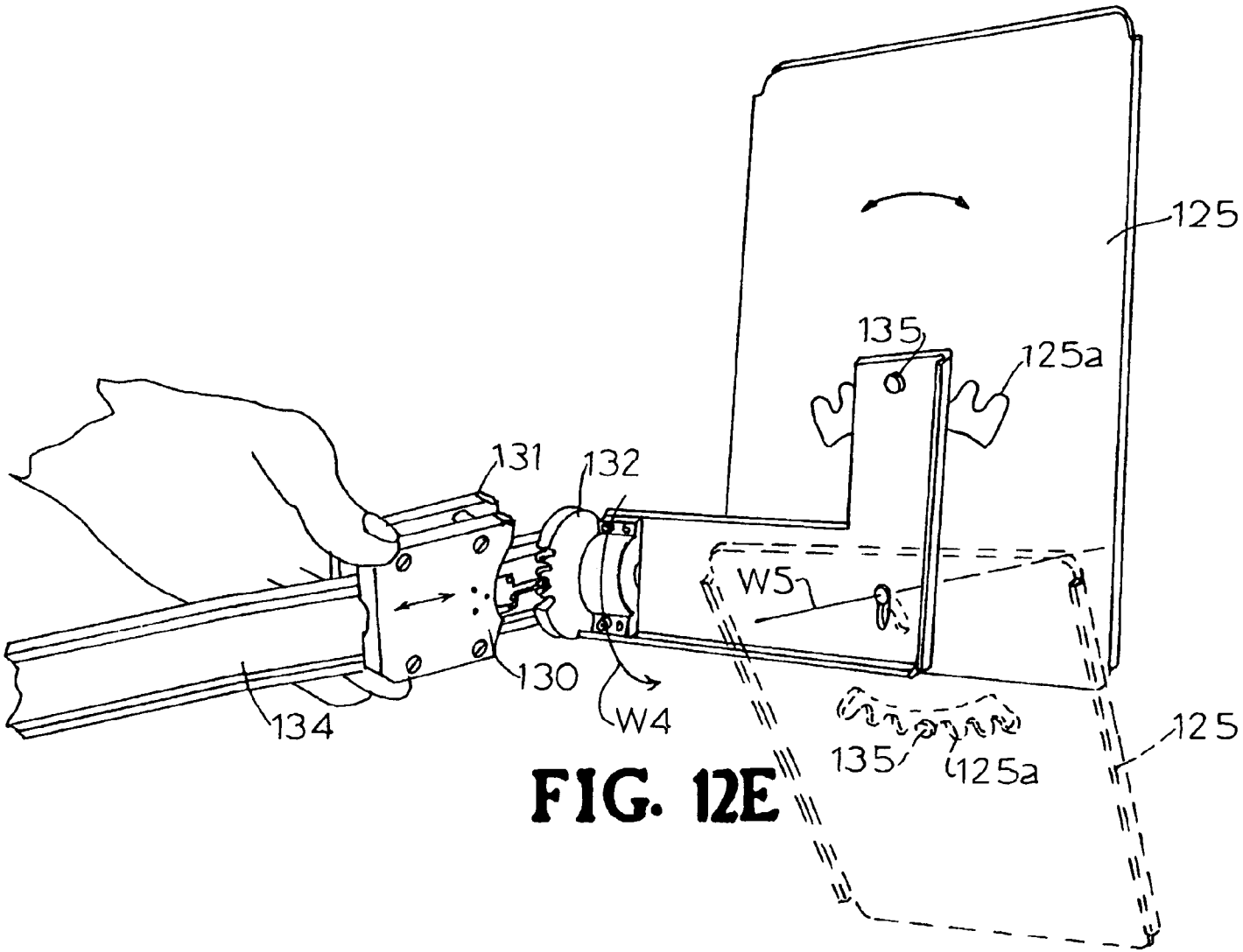
FIG. 12E is an enlarged fragmentary perspective view showing the fourth stage of rotation wherein the footrest attachment member has been rotated 180 degrees to the other side of the tibial-cantilevered cradle (not shown) to receive a person's left foot and the footplate has been rotated upward 180 degrees to receive a person's left foot.

FIG. 12D illustrates the positioning of footplate support 134. It has now been rotated 180 degrees about axis W3 to the other side of tibial-cantilevered cradle 80. FIG. 12E illustrates how spring-loaded plates 130 and 131 are pulled back to allow upward rotation of footplate support member 126 and footplate 125 about axis W4. Plates 130 and 131 are then released locking footplate support member 126 and footplate 125 in place on the ratcheting cog assembly 132. Footplate 125 can be adjusted side to side about axis W5

Figure 13:
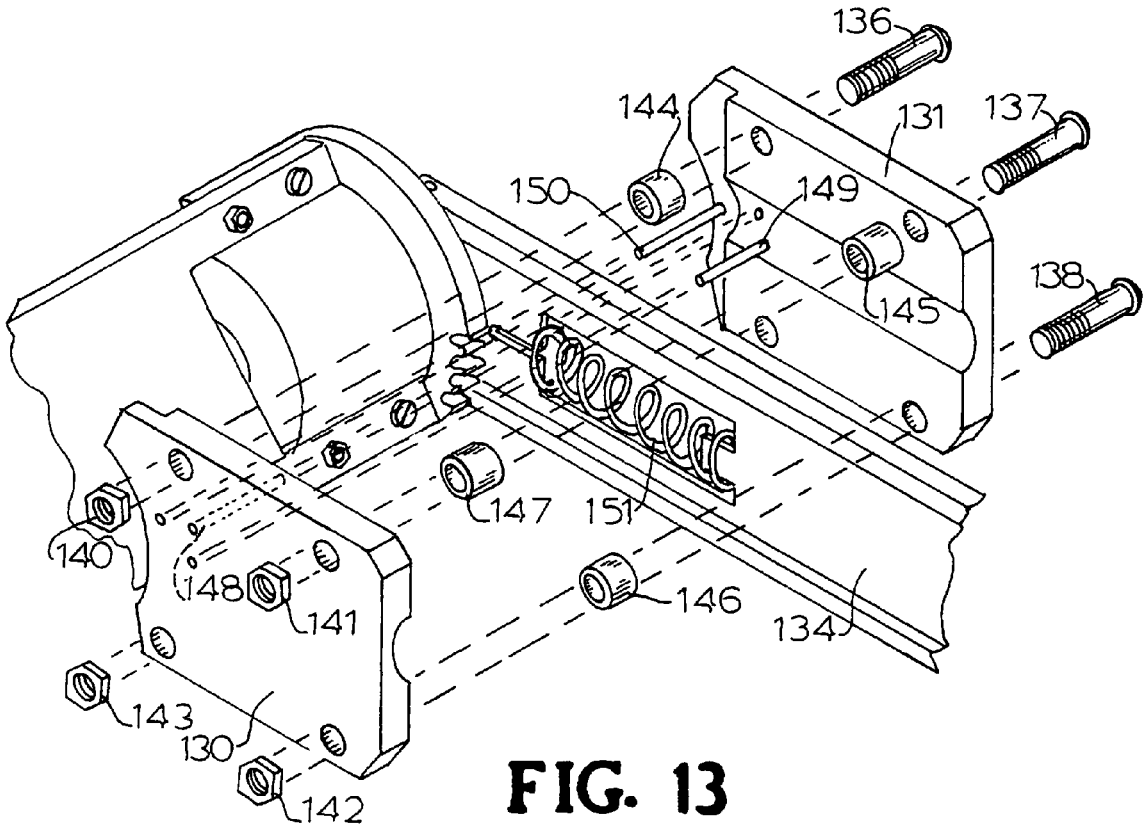
FIG. 13 is an exploded perspective view of the spring mounting arrangement of the footplate adjustment mounting apparatus.
Figure 14:
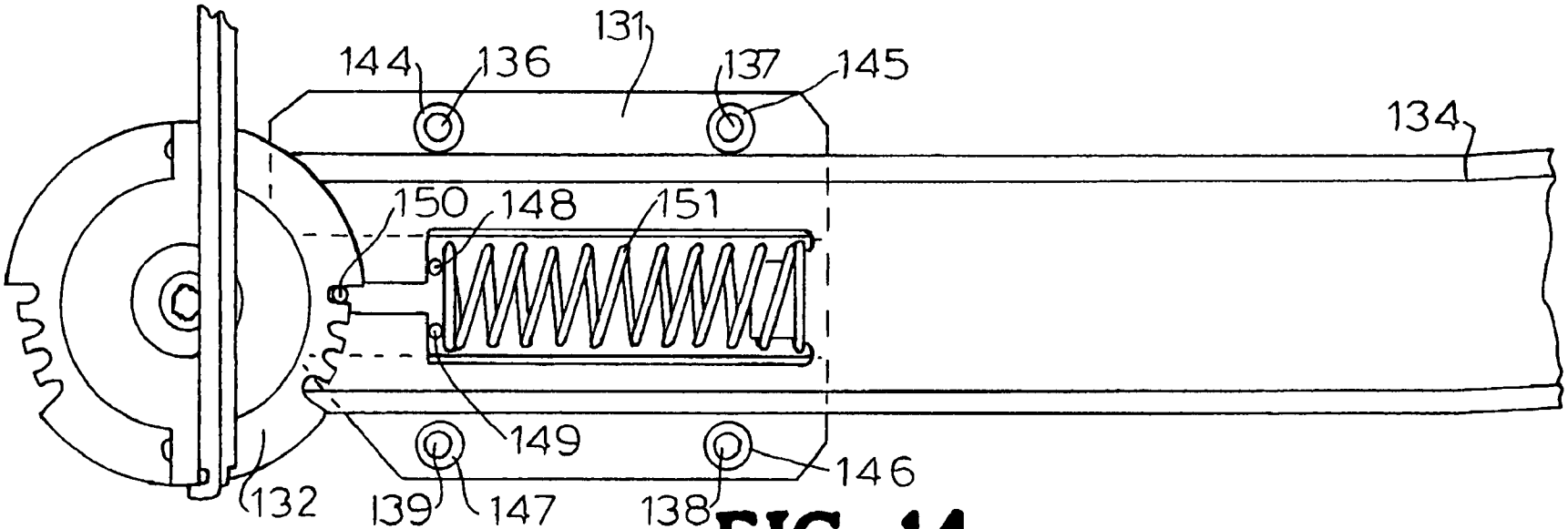
FIG. 14 is a side view of the spring mounting arrangement seen in FIG. 13 with one of its side plates removed.

FIG. 13 is an exploded view of spring-loaded plates 130 and 131. Plates 130 and 131 are joined by bolts 136, 137, 138, and 139 (hidden) and nuts 140, 141, 142 and 143. Rollers 144, 145, 146 and 147 allow plates 130 and 131 to slide forward and backward on footplate attachment member 134. Pins 148, 149, and 150 align plates 130 and 131 and pin 149 provides compression of spring 151 when the assembly is pulled backward. FIG. 14 illustrates how pin 150 locks in place in the ratcheting cog assembly 132 and thereby locking in place footplate 125 and footplate support member 126.

FIG. 15 is a partial section view of the slide mechanism for the femoral-cantilevered cradle 70. Femoral slide mechanism 115 slides along tracks 31*a* and 31*b* via bolts 116*a*, 116*b* (hidden), 116*c*, and 116*d* (hidden) and nuts 117*a*, 117*b* (hidden), 117*c* and 117*d* (hidden).

Figure 16:
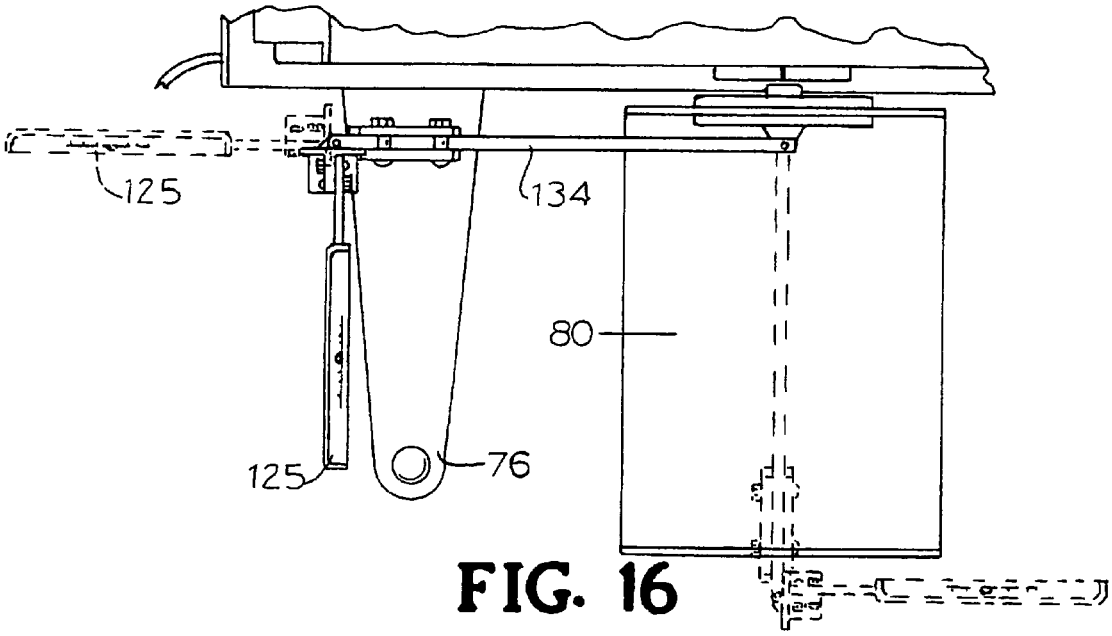
FIG. 16 is fragmentary plan view of the tibial-cantilevered cradle and foot plate attachment member showing the adjustability of the foot plate attachment member to swivel from one side of the tibial cradle to the other side as well as the ability of the foot plate and footplate support member to extend in line with the foot plate attachment member during changeover from one side of the apparatus to the other side.

FIG. 16 is a fragmentary plan view of the tibial-cantilevered cradle 80 and foot plate attachment member 134 showing the adjustability of the foot plate attachment member 134 to swivel from one side of the tibial-cantilevered cradle 80 to the other side as well as the ability of the foot plate 125 and footplate support member 126 to extend in line with the foot plate attachment member 134 during changeover from one side of the apparatus 20 to the other side.

Figure 17:
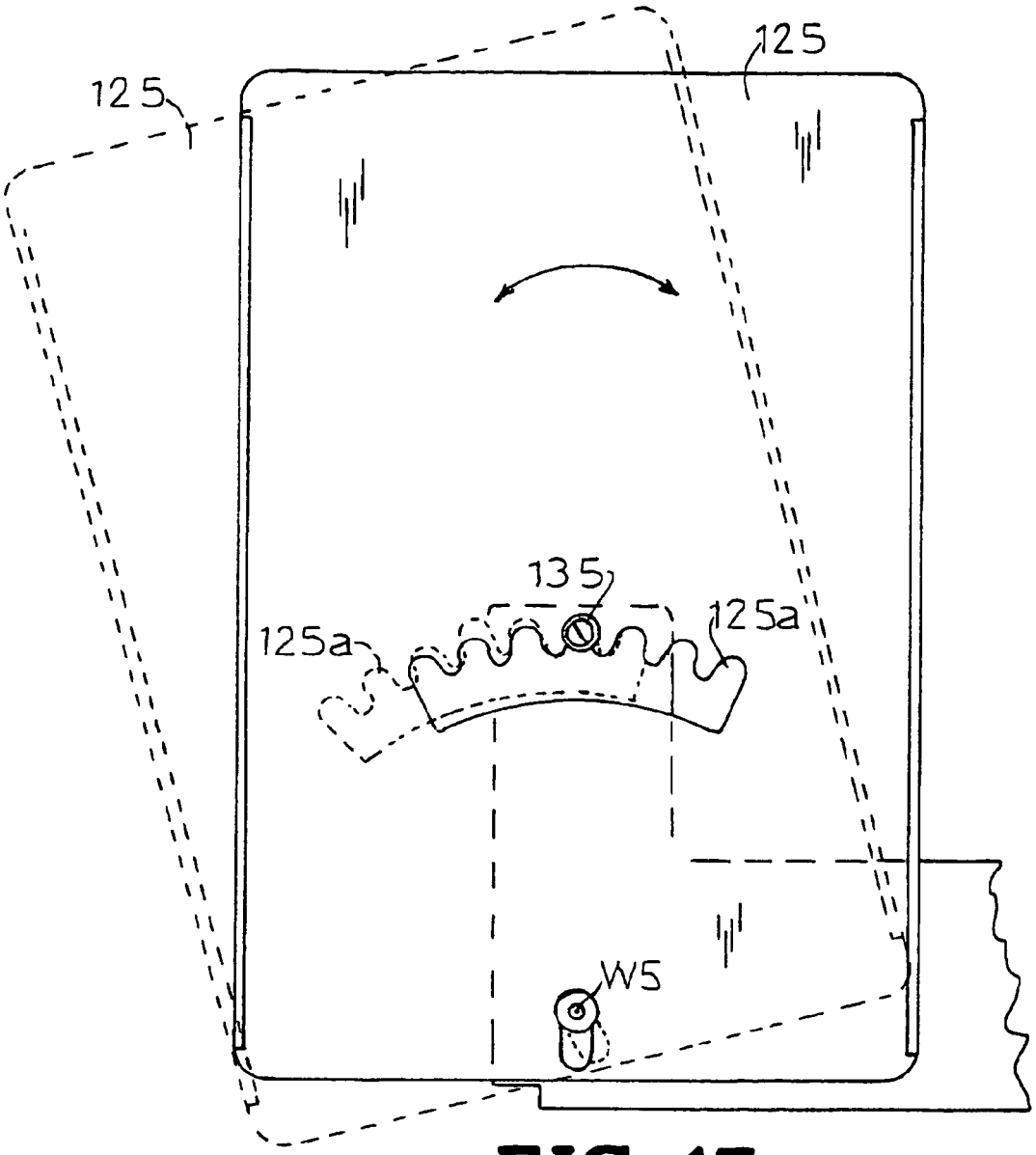
FIG. 17 is a fragmentary plan view of the foot plate showing in dashed lines its ability to adjust from side to side.

FIG. 17 is a fragmentary plan view and illustrates how footplate 125 is able to adapt to different foot configurations and can be fixed at various angles of rotation about axis W5 perpendicular to tibial-cantilevered cradle 80 by adjusting screw 135 in one of the various footplate openings 125*a*.

Figure 18:
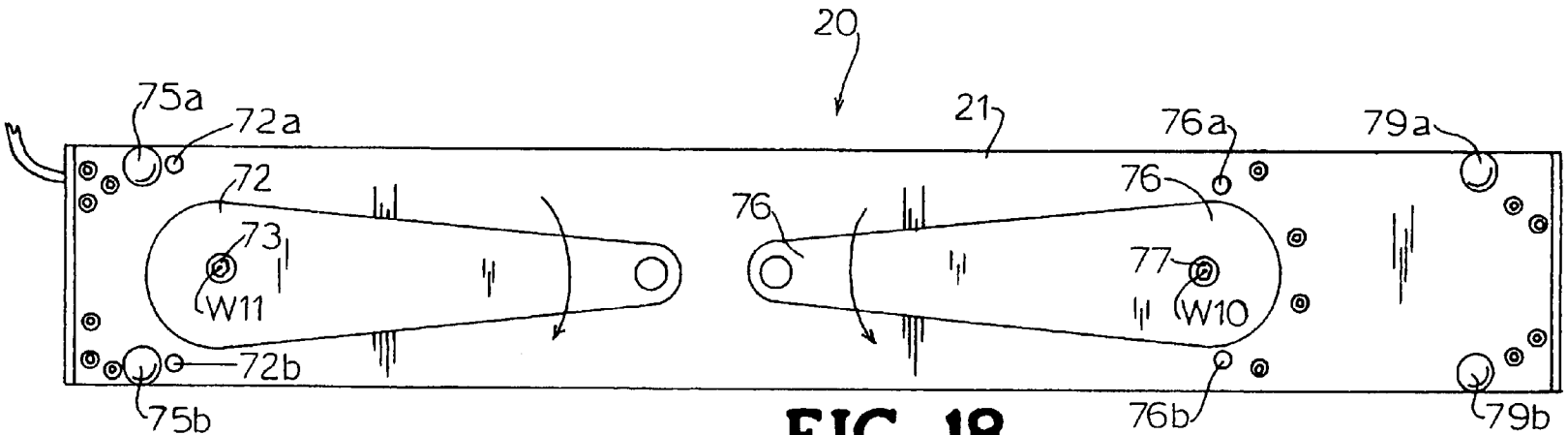
FIG. 18 is a bottom plan view of the apparatus of FIG. 1 showing the position of the stabilizing arms rotated underneath the base of the apparatus during transport.

FIG. 18 is a bottom plan view of apparatus 20 and illustrates how the stabilizing arms 72 and 76 can be positioned for transport. Stabilizing arms 72 and 76 can be rotated 180 degrees around base element 21 by means of pivots 73 and 77 respectively to provide support during CPM of either a right or left leg. Stops 74*a* and 74*b* stop the rotation of stabilizing arm 72 and stops 78*a* and 78*b* stop the rotation of stabilizing arm 76. Bumper pads 75*a*, 75*b* and 79*a* and 79*b* provide cushioning stability when the apparatus 20 is positioned on a supporting surface.

Figure 19:
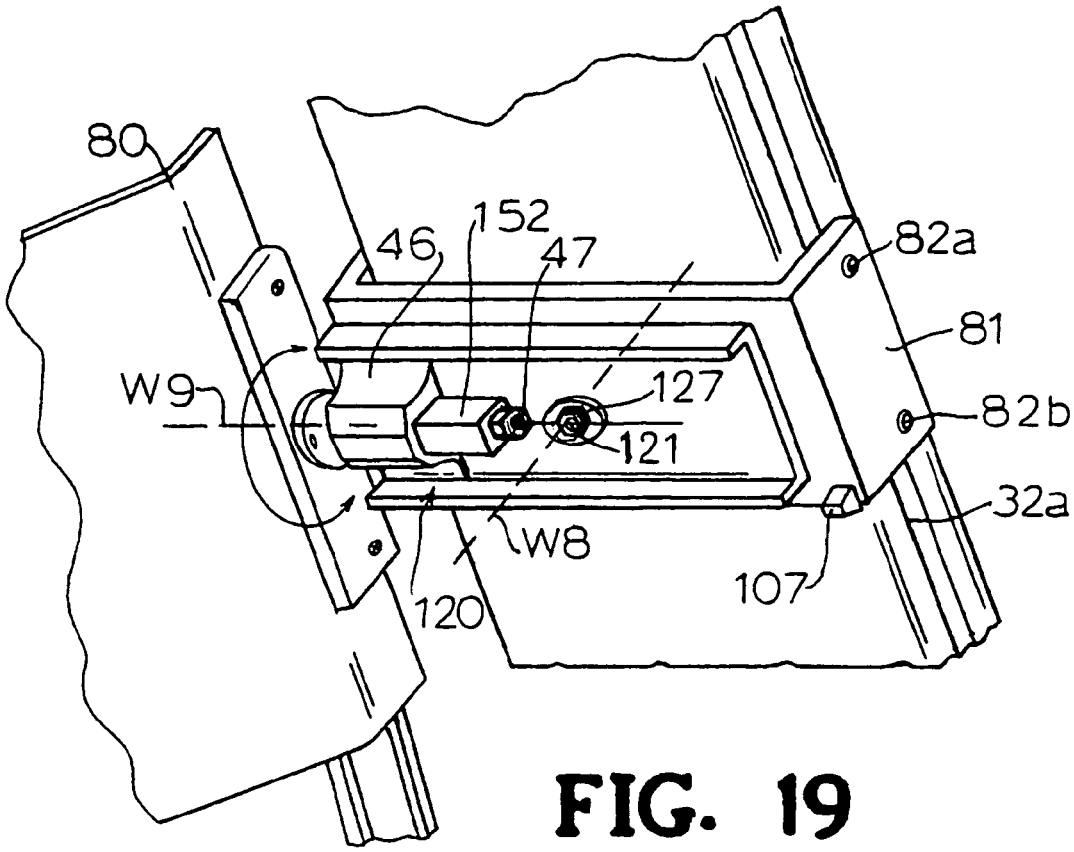
FIG. 19 is a fragmentary view of the tibial support member and its associated tibial-cantilevered cradle illustrating an alternative embodiment with the addition of a tibial potentiometer.

FIG. 19 is a fragmentary bottom view of the tibial support member and its associated tibial-cantilevered cradle illustrating an alternative embodiment with the addition of a tibial angle input potentiometer 152. Tibial angle input potentiometer 152 is added as an alternate means of calculating the knee angle, as opposed to the use of the graduated scale 85 (see FIG. 6). In the first embodiment, graduated scale 85 is used to determine the patient's leg size, which is then input as one of the data elements into the control panel 90 (see FIG. 9) so that microprocessor 91 can adjust the movement for the size leg supported by apparatus 20. In the alternate embodiment, tibial angle input potentiometer 152 works in conjunction with femoral angle input potentiometer 100 to input to microprocessor 91 for direct calculation of the user's leg size without needing the user to input such data.

I claim:

1. An apparatus for receiving and supporting respective femoral and tibial portions of a person's leg and flexing the knee joint thereof comprising:

(a) a pair of elongated femoral and tibial support members each being pivotally connected to the other at one end, said femoral support member at its opposite end being pivotally mounted at a fixed position on a base and said tibial support member at its opposite end having a drive connection;

(b) a first rigid cantilevered cradle mounted on said femoral support member for reciprocally moving alongside, lengthwise of and along a path parallel to and outwardly of said femoral support member and adapted while so moving for supporting said femoral portion of said leg;

(c) a second rigid cantilevered cradle mounted on said tibial support member for reciprocally moving alongside, lengthwise of and along a path parallel to and outwardly of said tibial support member and adapted while so moving for supporting said tibial portion of said leg; and (d) a drive source connected to said tibial support member drive connection and operative for cyclically reciprocating said drive connection and thereby forcing said support members to cyclically contract and expand around the axis of the said pivotal connection therebetween and in coordination therewith to flex said knee joint; and wherein said cradles in response to and during said contraction and expansion reciprocate each along its respective said path as required to maintain the respective femoral and tibial portions in substantially fixed positions on said respective cradles.

2. An apparatus as claimed in claim 1 including a foot rest structure providing a plate against which the sole of the foot of said leg can rest, wherein said foot rest structure is mounted on, forwardly of and movable with said second cradle and in a manner which permits the angle of the plane of said plate with respect to the vertical, and the tilt of said plate around an axis perpendicular to the plane of said plate at the base thereof to be manually adjusted.

3. An apparatus as claimed in claim 1 wherein said apparatus includes a motor control mount on said femoral support member in a position accessible to the user of said apparatus.

4. An apparatus as claimed in claim 1 wherein said apparatus includes a housing on said femoral support member and a control mounted in said housing in a position accessible to the user of said apparatus.

5. An apparatus as claimed in claim 1 wherein said femoral support member at its said opposite end contains an electrical sensor for producing an electrical signal responsive to the angular relation of said femoral support member to said base.

6. An apparatus as claimed in claim 1 wherein the connection between said drive connection and said drive source comprises a link pivotally connected at one end to said drive source and at an opposite end fixedly connected to said drive connection whereby to maintain said tibial support member and link in a fixed angular relation.

7. An apparatus as claimed in claim 1 wherein each of said cradles in addition to being mounted for reciprocally moving along its respective said path alongside its respective said support member is also mounted in a manner which enables each said cradle to be rotatively positioned on either side of its respective said support member and thereby adapt said apparatus for use by either the right or left leg of the user of said apparatus.

8. An apparatus as claimed in claim 1 wherein said drive source comprises an internally threaded drive member mounted on a motor driven threaded shaft, said drive member being connected to said drive connection and including a control for remotely controlling the motor which drives said shaft.

9. An apparatus as claimed in claim 1 wherein at least one of said support members includes a housing, said apparatus includes a manually positionable control for controlling the operation of said drive source and said control is mounted on said housing at a location accessible to an individual using said apparatus.

10. An apparatus as claimed in claim 1 wherein said second cradle in addition to being mounted for moving along its respective said path alongside its respective said tibial support member is also mounted in a manner which permits said second cradle to rotate around an axis transverse of said tibial support member.

11. An apparatus as claimed in claim 4, wherein said second cradle in addition to being mounted for moving along its respective said path alongside its respective said support member is also mounted in a manner which permits said second cradle to rotate around an axis transverse of said tibial support member.

12. An apparatus as claimed in claim 7, wherein said second cradle in addition to being mounted for moving along its respective said path alongside its respective said support member is also mounted in a manner which permits said second cradle to rotate around an axis transverse of said tibial support member.

13. An apparatus as claimed in claim 1 including a footrest structure mounted on and extending forwardly of said second cradle.

14. An apparatus as claimed in claim 1 wherein said drive source includes a reversible drive motor, a drive screw driven by said motor, an internally threaded drive member mounted on said screw and connected to said drive connection for thereby forcing said support members to cyclically retract and expand.

15. An apparatus as claimed in claim 1 including a footrest structure mounted on and extending forwardly of said second cradle, said second cradle being mounted in a manner which permits said second cradle to rotate around an axis transverse of said tibial support member in coordination with flexing of said joint.

16. A method for flexing a knee joint comprising:

(a) supporting respective femoral and tibial portions of the leg in respective substantially rigid femoral and tibial cantilevered support cradles slidably mounted on respective elongated femoral and tibial support members connected by a pivotal joint; and (b) forcing the support members to cyclically pivot around the axis of said pivotal joint and, as a consequence, to cause said respective femoral and tibial portions of said leg to cyclically extend and contract by extending and contracting the support members about said axis.

17. A method, as claimed in claim 16 including the step of controlling said extending and contracting of the support members by use of a manually adjustable control mounted on one of said support members.

18. An apparatus for applying motion to a jointed limb, such as a leg of a patient's body, comprising:

(a) a stationary base structure;

(b) a drive assembly providing a drive member and associated timed drive means for reciprocating said drive member on said base structure;

(c) an elongated femoral support member extending between a first end pivotally connected to said base structure and a second end;

(d) an elongated tibial support member extending between a first end pivotally connected to the second end of said femoral support member and a second end;

(e) a first sliding element connected to slide on said femoral support member and having rigidly mounted and cantilevered outward therefrom a rigid femoral cradle;

(f) a second sliding element connected to slide on said tibial support member and having rigidly mounted and cantilevered outwardly therefrom a rigid tibial cradle; and (g) connector means connecting said second end of said tibial support member to said drive member whereby to cause respective femoral and tibial portions of said limb when supported in the respective said femoral and tibial cradles to extend and flex said limb while permitting said respective femoral and tibial cradles to slide along said respective support members in coordination with flexing of the joint between said portions.

19. An apparatus as claimed in claim 18 wherein said femoral support member includes a housing and including a control mounted on said housing for controlling said drive assembly.

20. A method for flexing a knee joint, together with femoral and tibial portions of the leg bounding said joint, comprising:

(a) creating an apparatus for applying motion to a leg of a patient's body, comprising:

(i) a stationary base structure;

(ii) a drive assembly providing a drive member and associated timed drive means for reciprocating said drive member on said base structure along a fixed linear path;

(iii) an elongated femoral support member extending between a first end pivotally connected to said base structure and a second end;

(iv) an elongated tibial support member extending between a first end pivotally connected to the second end of said femoral support member and a second end;

(v) a first sliding element connected to slide on said femoral support member and having rigidly mounted and cantilevered outward therefrom a rigid femoral support cradle;

(vi) a second sliding element connected to slide on said tibial support member end having rigidly mounted and cantilevered outwardly therefrom a rigid tibial support cradle;

(vii) a connecting member fixedly connected at an upper end thereof to said second end of said tibial support member and at a lower end thereof pivotally connected to said drive member; and (viii) a footrest structure supported on and extending forwardly of said second sliding element and providing a pivotal rest for the foot of said leg;

(b) mounting the femoral portion of said leg on said rigid femoral support cradle;

(c) mounting the tibial portion of said leg on said rigid tibial support cradle;

(d) resting the sole of the foot of said leg on said footrest structure; and (e) activating said drive assembly such that said drive assembly, when in operation, causes flexing and extension of said limb, and which thereby tends to flex the joint between femoral and tibial portions of said limb in response to reciprocation of said drive member.

21. An apparatus for applying motion to a leg of a patient's body, comprising:

(a) a stationary base structure;

(b) an elongated femoral support member extending between a first end pivotally connected to said base structure and a second end;

(c) an elongated tibial support member extending between a first end pivotally connected to the second end of said femoral support member and a second end;

(d) a first sliding element connected to slide on said femoral support member and having rigidly mounted and cantilevered outward therefrom a rigid femoral support cradle and wherein said femoral support cradle is pivotally attached to said femoral support member in a manner which allows said femoral support cradle to pivot about said femoral support member and stop on either side of said femoral support member so as to accommodate either a right or left leg;

(e) a second sliding element connected to slide on said tibial support member and having rigidly mounted and cantilevered outwardly therefrom a rigid tibial support cradle;

(f) a drive assembly mounted on said base structure, comprising:

(i) a drive screw extending lengthwise of said base structure;

(ii) a controlled drive source for driving said drive screw; and (iii) an internally-threaded nut mounted on said screw;

(g) a first link pivotally mounted at a lower end thereof on said nut and at an upper end thereof fixedly connected to the said second end of said tibial support member;

(h) a second link extending forwardly of said second sliding element having an outer end mounting a footrest thereon, an inner end mounted on said second sliding element;

(i) a mounting structure attaching said tibial support cradle to said tibial support member which enables tibial support cradle to pivot about said tibial support member and stop on either side of said tibial support member so as to accommodate either a right or left leg;

(j) an auxiliary support mounted on said second drive link outer end for supporting, in a fixed position, a heel portion of said leg; and (k) wherein said support members, sliding elements, links, and auxiliary support are arranged such that said drive assembly, when in operation, tends to flex the joint between femoral and tibial portions of said leg.

22. An apparatus for applying therapeutic motion to a leg of a patient's body, comprising:

(a) a stationary base member;

(b) a drive assembly providing a drive member and associated timed drive means for reciprocating said drive member on said base structure along a fixed linear path;

(c) an elongated femoral support member extending between a first end pivotally connected to said base structure and a second end;

(d) an elongated tibial support member extending between a first end pivotally connected to the second end of said femoral support member and a second end;

(e) a first sliding element connected to slide on said femoral support member and having rigidly mounted and cantilevered outward therefrom a rigid femoral support cradle;

(f) a second sliding element connected to slide on said tibial support member and having rigidly mounted and cantilevered outwardly therefrom a rigid tibia support cradle;

(g) a connecting member having an upper end fixedly connected to said tibial support member second end and a lower end pivotally connected to said drive member;

(h) a footrest structure mounted on and forwardly of said second sliding element and providing a footrest for the foot of said leg; and (i) wherein said support members, sliding elements, connecting member, and footrest structure are arranged such that said limb is cyclically flexed and extended in response to reciprocation of said drive member.

* * * * *